US011466227B2

(12) United States Patent
DeBlase

(10) Patent No.: US 11,466,227 B2
(45) **Date of Patent: *Oct. 11, 2022**

(54) SYNERGY AND ENHANCED PERFORMANCE RETENTION WITH ORGANIC AND MOLYBDENUM BASED FRICTION MODIFIER COMBINATION

(71) Applicant: LANXESS Corporation, Pittsburgh, PA (US)

(72) Inventor: Frank J. DeBlase, Hopewell Junction, NY (US)

(73) Assignee: LANXESS Corporation, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/755,111

(22) PCT Filed: Oct. 15, 2018

(86) PCT No.: PCT/US2018/055850

§ 371 (c)(1),
(2) Date: Apr. 9, 2020

(87) PCT Pub. No.: WO2019/079170

PCT Pub. Date: Apr. 25, 2019

(65) Prior Publication Data

US 2020/0255763 A1 Aug. 13, 2020

Related U.S. Application Data

(60) Provisional application No. 62/572,945, filed on Oct. 16, 2017, provisional application No. 62/723,093, filed on Aug. 27, 2018.

(51) Int. Cl.
*C10M 141/12* (2006.01)
*C10N 30/00* (2006.01)
(Continued)

(52) U.S. Cl.
CPC .... *C10M 141/12* (2013.01); *C10M 2201/062* (2013.01); *C10M 2215/04* (2013.01);
(Continued)

(58) Field of Classification Search
CPC ..... C10M 2215/082; C10M 141/12; C10M 2201/062; C10M 2215/04;
(Continued)

(56) References Cited

U.S. PATENT DOCUMENTS 4,512,903 A 4/1985 Schlicht et al.
4,729,769 A 3/1988 Schlicht et al.
(Continued)

FOREIGN PATENT DOCUMENTS

JP 07150170 A 6/1995
JP 07150173 A 6/1995
(Continued)

OTHER PUBLICATIONS

International Search Report and Written Opinion from International Application No. PCT/US18/55850, dated Dec. 20, 2018, ten pages.
(Continued)

*Primary Examiner* — Ellen M McAvoy
(74) *Attorney, Agent, or Firm* — Nicanor A. Kohncke; Christopher L. McDavid; Ewa M. Wozniak

(57) ABSTRACT

An improved organic and molybdenum friction modifier combination is disclosed, the combination resulting in a synergistic result of both initial friction reduction performance and a further retention and durability of continued friction reduction performance. These results will produce added benefit from, e.g., formulated passenger car motor oils targeting lower viscosity formulations to help improve fuel economy.

29 Claims, 9 Drawing Sheets

(51) Int. Cl.
*C10N 10/12* (2006.01)
*C10N 30/02* (2006.01)

(52) U.S. Cl.
CPC . *C10M 2215/082* (2013.01); *C10M 2219/068* (2013.01); *C10N 2010/12* (2013.01); *C10N 2030/02* (2013.01); *C10N 2030/54* (2020.05)

(58) Field of Classification Search
CPC ..... C10M 2219/068; C10N 2030/54; C10N 2010/12; C10N 2030/02
USPC ..... 508/555
See application file for complete search history.

(56) References Cited

U.S. PATENT DOCUMENTS 4,921,624 A 5/1990 Kammann, Jr.
5,498,809 A 3/1996 Emert et al.
6,103,674 A 8/2000 Nalesnik et al.
6,300,291 B1 * 10/2001 Hartley ..... C10M 129/40 508/363
6,723,685 B2 4/2004 Hartley et al.
7,696,136 B2 4/2010 Migdal et al.
9,562,207 B2 2/2017 Deblase et al.
2004/0192565 A1 11/2004 Thiel et al.
2010/0210487 A1 8/2010 Deblase et al.
2012/0122744 A1 * 5/2012 Saccomando ..... C10M 133/16 508/162
2015/0024986 A1 * 1/2015 Loper ..... C10M 141/10 508/375
2015/0376537 A1 * 12/2015 DeBlase ..... C10M 133/16 508/555
2016/0251591 A1 9/2016 Deblase et al.
2016/0369199 A1 * 12/2016 Suen ..... C10M 159/18
2017/0121626 A1 * 5/2017 Nakaya ..... C10M 129/76
2019/0264125 A1 * 8/2019 Iino ..... C10M 169/04
2020/0332207 A1 * 10/2020 Yavari ..... C07C 231/02
2020/0354644 A1 * 11/2020 DeBlase ..... C10M 169/04
2020/0362259 A1 * 11/2020 Simms ..... C10M 129/36
2021/0253973 A1 * 8/2021 Iino ..... C10M 135/18

FOREIGN PATENT DOCUMENTS

JP 2003221588 A2 8/2003
JP 2008266489 A2 11/2008

OTHER PUBLICATIONS

Guegan,et al., "Friction Modifier Additives, Synergies and Antagonisms," Tribology Letters (2019) 67:83.

* cited by examiner

SYNERGY AND ENHANCED PERFORMANCE RETENTION WITH ORGANIC AND MOLYBDENUM BASED FRICTION MODIFIER COMBINATION

This application claims priority benefit to U.S. Provisional Application No. 62/572,945, filed Oct. 16, 2017, and U.S. Provisional Application No. 62/723,093, filed Aug. 27, 2018, both of which are incorporated herein by reference in their entirety.

FIELD OF THE INVENTION

Friction reduction additive compositions providing exceptional durability and outstanding friction reduction activity are disclosed. The friction reduction additive composition of the present disclosure comprises one or more fatty acid 2-hydroxyalkylamides, i.e., alkanolamides, and a molybdenum based lubricating oil additive.

BACKGROUND OF THE INVENTION

Engines and their associated parts use lubricants to facilitate the movement of internal components and improve and/or lengthen their respective working lifetimes. These lubricants typically comprise lubricating oils plus various additives, which together possess a number of desirable lubricating properties serving multiple functions, e.g., reducing soot/sludge formation, preventing or slowing corrosion or oxidation, reducing friction and wear, etc. Additives also directly impact the lubricant itself by slowing thermal decomposition and the like. Generally, over the lifetime of a lubricant, the additives are depleted and/or change form, reducing their effectiveness, resulting in degradation of the lubricant compositions, which, over time, ultimately must be replaced.

Currently, the trend for reduced lubricant viscosity is requiring the development of formulations with high amounts of strongly performing friction modifiers. It is important for the performance of the lubricant that these FM additives not only have high initial activity, but also that they retain their performance over time, or the lubricant will need to be changed more often as it ceases to function as required.

A variety of friction modifiers for use in lubricants, such a motor oils, are known, including metal containing materials, such as organo molybdenum compounds, and fully organic compounds, such as fatty acid esters and amides, esters of hydroxyalkyl acids and the like.

Molybdenum friction modifiers are effective over a broad temperature range, especially upon reaching temperatures of ~120° C. or higher, where chemical transformations form Mo-Sulfide glass coatings on surfaces. Many molybdenum friction modifiers are known and many are commercially available, such as molybdenum dialkyldithiocarbamates, molybdenum dialkyl dithiophosphates, molybdenum disulfide, tri-molybdenum cluster dialkyldithiocarbamates, non-sulfur molybdenum compounds and the like.

U.S. Pat. No. 6,103,674 discloses a molybdenum based lubricating oil additive that comprises the reaction product of: (a) an unsaturated or saturated ester or acid, (b) a diamine of the formula:

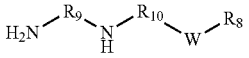

(c) carbon disulfide, and (d) a molybdenum compound, wherein $R_8$ is an alkyl group of 1 to 40 carbon atoms, $R_9$ and $R_{10}$ are independently selected aliphatic or aromatic moieties, and W is oxygen, sulfur, or —$CH_2$—. In addition to friction modification, the additive is said to impart beneficial antiwear, extreme pressure, and oxidation stability properties. These additives, being the reaction products of mono- or poly-functional organic acids or esters and an aliphatic diamine that are further reacted with carbon disulfide and then with molybdenum compounds, are complex mixtures.

Molybdenum compounds have drawbacks however, for example, they can complex and interfere with dispersants, and contribute to ash and particulate formation, etc. Reduction of the amount of molybdenum used in lubricants is therefore desirable. Some molybdenum-based additives, such as ones found in U.S. Pat. No. 6,103,674, have lower amounts by weight of molybdenum than other commercial friction modifiers, but even lower concentrations are desired. However, simply reducing the load level of molybdenum compounds in a lubricant provides less friction reduction.

Fatty acid alkanolamides are known as both fuel additives and lubricant additives. U.S. Pat. No. 4,729,769 discloses gasoline compositions containing reaction products of fatty acid esters and alkanolamines as carburetor detergents, e.g., the product of diethanolamine with coconut oil. US Pub Pat Appl 20040192565 discloses the same compounds as friction modifiers for lubricants. U.S. Pat. No. 4,921,624 discloses alkanolamide lubricant additives similar to those of US Appl 20040192565, prepared by reacting a substantially saturated fatty acid triglyceride with a deficiency of dialkanolamine. U.S. Pat. No. 4,512,903 provides lubricant compositions containing amides of hydroxy-substituted aliphatic acids and long chain fatty amines.

U.S. Pat. No. 9,562,207 discloses a mixture of fatty acid amides, prepared by reacting a naturally occurring mixture of carboxylic acids or esters, e.g., acids or esters from beef tallow, with a secondary hydroxyalkyl amine, e.g., di-isopropanolamine, which fatty acid amides show improved friction reduction activity over similar compounds, e.g., amides formed from fatty acids or esters and a primary hydroxyalkyl amine, such as di-ethanolamine.

Lubricants formulated with molybdenum based friction modifiers, or those formulated with molybdenum based friction modifiers combined with organic friction modifiers, generally show initial friction reduction, however, the friction reduction performance is lost over time. In a passenger car motor oil, for example, friction reduction results in improved mileage. In these system, molybdenum based friction modifiers are known to form a molybdenum disulfide polymeric tribofilm glass on engine surfaces. However, this tribofilm is known to oxidize with prolonged exposure to oxygen at elevated temperatures, which causes the surface to become rough, and friction reduction is lost.

Delaying the loss of friction reduction performance by inhibiting oxidation and/or protecting the tribofilm will allow for extended mileage performance. Conventional solutions to these problems generally lead to greater doses of metal containing friction modifiers leading to increased metal particulates, or more frequent oil changes increasing the use natural resources.

As described herein, the friction reduction additive composition of the present disclosure overcomes these problems, achieving superior friction reduction performance without the aforementioned drawbacks.

SUMMARY OF THE INVENTION

A friction reduction additive composition with excellent long-term performance is provided, comprising one or more fatty acid alkanolamide compounds of formula (I):

(I)

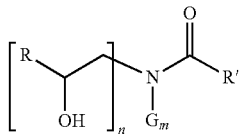

wherein n is 1 or 2; when n is 1, m is 1; when n is 2, m is 0,

R is H or $C_{1-12}$ alkyl,

G is H or $C_{1-6}$ alkyl, and

R' is selected from $C_{7-23}$ alkyl or alkenyl; and a molybdenum based lubricating oil friction reducing additive. In some embodiments, the one or more fatty acid alkanolamide compounds of formula (I) are one or more compounds of formula II:

(II)

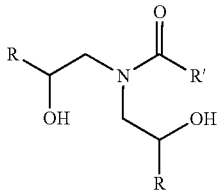

wherein R is H or $C_{1-12}$ alkyl, and R' is selected from $C_{7-23}$ alkyl or alkenyl.

In some embodiments, the friction reduction additive composition comprises a mixture of fatty acid alkanolamide compounds of formula (I) or (II), i.e., two or more fatty acid alkanolamide compounds of formula (I) or (II). In some embodiments, at least one fatty acid alkanolamide is a compound of formula (I) or (II) wherein R is selected from $C_{1-12}$ alkyl, such as $C_{1-8}$ alkyl or $C_{1-4}$ alkyl, e.g., methyl or ethyl.

The present disclosure is not limited to a particular type of molybdenum based lubricating oil additive, so long as the molybdenum additive has friction reducing properties. For example, the molybdenum based lubricating oil additive may be chosen from friction reducing additives known in the art. Suitable molybdenum based friction reducing additives include, but are not limited to, molybdenum dithiocarbamates (MoDTC) (e.g., mono-molybdenum dithiocarbamates, di-molybdenum dithiocarbamates, tri-molybdenum cluster dithiocarbamates, etc.), molybdenum dithiophosphates, molybdenum dithiophosphinates, molybdenum xanthates, molybdenum thioxanthates, molybdenum alcoholates, molybdenum amines, molybdenum amides, molybdenum sulfides (e.g., molybdenum disulfide), non-sulfur molybdenum compounds, and mixtures thereof. The molybdenum compounds may be, e.g., mono-, di-, tri-, or tetra-nuclear. In some embodiments, the molybdenum based friction reducing additive includes one or more sulfur-containing molybdenum based compounds or complexes. In some embodiments, the molybdenum based friction reducing additive is chosen from molybdenum dithiocarbamates (MoDTC), molybdenum dithiophosphates, molybdenum dithiophosphinates, molybdenum xanthates, molybdenum thioxanthates, molybdenum sulfides, and mixtures thereof.

The molybdenum based lubricating oil friction reducing additive may comprise a mixture of molybdenum based compounds. Other molybdenum based compounds in addition to those described above may be present.

The molybdenum based friction reducing additive and the one or more fatty acid alkanolamides may be present in the friction reduction additive composition at a weight ratio of, e.g., 5:1 to 1:5 of the molybdenum additive to the alkanolamides. In some embodiments, the weight ratio is 3:1 to 1:3 or 1:1.1 to 1:5.

Also provided is a lubricant composition comprising a lubricating oil and a friction reducing effective amount of the friction reduction additive composition of the present disclosure. The lubricant composition comprises a lubricating oil; one or more fatty acid alkanolamide compounds of formula (I) or (II) as above, and a molybdenum based lubricating oil friction reducing additive. The lubricating oil may be present in the lubricant composition at, e.g., more than 50 percent by weight based on the total weight of the lubricant composition. In some embodiments, the one or more fatty acid alkanolamide compounds of formula (I) or (II) and the molybdenum based lubricating oil friction reducing additive are present in the lubricant composition in a combined amount of from about 0.3 to about 3.0 weight percent based on the total weight of the lubricant composition. In various embodiments, the weight ratio of the molybdenum based lubricating oil friction reducing additive to the one or more fatty acid alkanolamide compounds is 5:1 to 1:5. In some embodiments, the weight ratio is 3:1 to 1:3 or 1:1.1 to 1:5.

Also disclosed is a method of improving the friction reduction performance of a lubricant composition, which lubricant composition comprises a lubricating oil comprising one or more naturally occurring base stocks or synthetic base stocks, the method comprising adding to the lubricating oil one or more fatty acid alkanolamide compounds of formula (I) or (II) as above, and a molybdenum based lubricating oil friction reducing additive. In some embodiments, the one or more alkanolamide compounds and the molybdenum based friction reducing additive are added individually to the lubricating oil. In other embodiments, the one or more alkanolamide compounds and the molybdenum based friction reducing additive are added collectively (e.g., in a blend) to the lubricating oil. The components may be added to the lubricating oil in amounts to achieve weight percentages and weight ratios as described herein.

The lubricant composition of the present disclosure exhibits excellent initial friction reduction and much better retention of friction reduction properties over time than could be expected by the activity of the molybdenum additive or alkanolamide alone. The present invention thus provides long term friction reduction while lowering the amount of molybdenum needed in lubricant compositions, such as those used in automobiles, trucks, and other high stress applications.

The preceding summary is not intended to restrict in any way the scope of the claimed invention. In addition, it is to be understood that both the foregoing general description and the following detailed description are exemplary and explanatory only and are not restrictive of the invention, as claimed.

DETAILED DESCRIPTION

Figure 1:
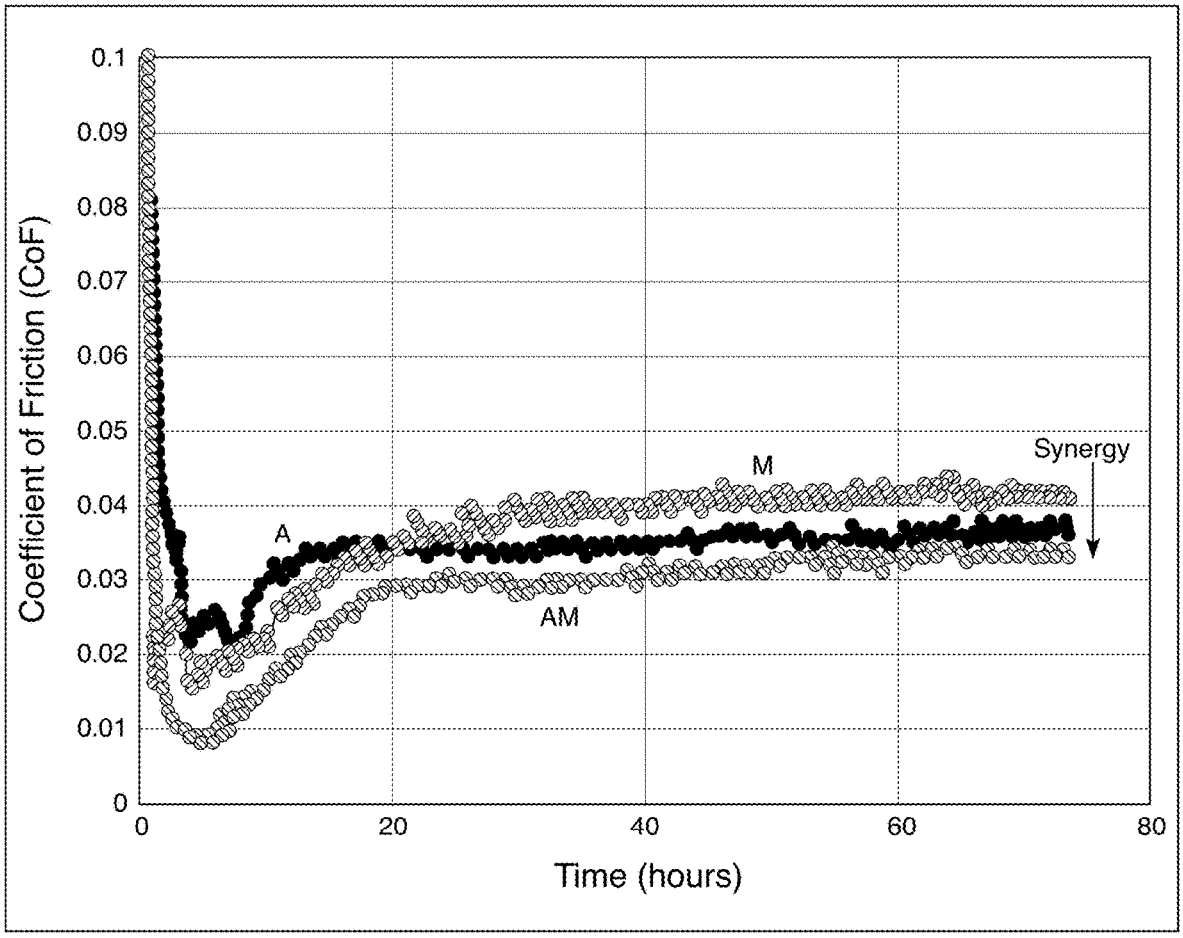
FIG. 1 shows the superior friction reduction performance over time of an exemplary additive composition according to the present disclosure.

Unless otherwise specified, the word "a" or "an" in this application means "one or more than one."

The present disclosure surprisingly shows that a combination of fatty acid 2-hydroxyalkylamides, i.e., alkanolamides, and a molybdenum based lubricating oil friction reducing additive exhibits exceptional durability and outstanding friction reduction performance.

While not wanting to be bound by theory, it is believed that the nature of the alkanolamide chemical structure, as described herein, with the polar hydroxyalkyl amide functionality and non-polar long chain may aid its miscibility with the MoDTC as the tribofilm is developed. This organic FM may thereby intimately contribute to overall friction reduction by adding its dynamic chemisorption self-assembly friction reduction layers to further enhance and fortify the glass type Molybdenum disulfide ($MoS_2$) tribofilm glass formed after thermal activation. In addition, the hydroxyamide functionality may serve to further react with any Molybdenum oxide formation to generate a new ester amide type Mo complex FM species to further reduce any increase in friction. Such complexes of fatty ester amides with Mo may act as organo-molybdenum friction modifiers.

The friction reduction additive composition of the present disclosure may comprise the molybdenum based friction reducing additive and the one or more fatty acid alkanolamides in a 5:1 to 1:5 weight ratio, e.g., 5:1, 4:1, 3:1, 2:1, 1.5:1, 1:1, 1:1.5, 1:2, 1:3, 1:4, or 1:5 weight ratio or any weight ratio therebetween, of the molybdenum additive to the alkanolamides. For example, the weight ratio of the molybdenum additive to the alkanolamides in the friction reduction additive composition may be from 4:1 to 1:4, from 3:1 to 1:3, from 2.5:1 to 1:2.5, from 2:1 to 1:2, from 1.5:1 to 1:1.5, or 1:1. In some embodiments, the weight ratio of the molybdenum additive to the alkanolamides in the friction reduction additive composition is from 1:1 to 1:5, such as 1:1.1 to 1:5, 1:1.2 to 1:4, 1:1.5 to 1:4, or 1:1.5 to 1:3.

The alkanolamides of the present disclosure may be prepared by known methods, e.g., reaction between an alkanol amine and a carboxylic acid or carboxylic acid derivative e.g., an ester, acid chloride, etc. Mixtures of compounds are conveniently prepared by using more than one alkanol amine and/or more than one carboxylic acid or carboxylic acid derivative during the reaction, although one can prepare individual amides and blend them. The alkanolamides of the present disclosure have a structure according to formula (I):

(I)

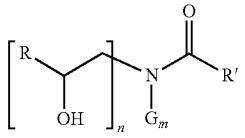

wherein n is 1 or 2; when n is 1, m is 1; when n is 2, m is 0,

R is H or $C_{1-12}$ alkyl (such as $C_{1-8}$ alkyl or $C_{1-4}$ alkyl, e.g., methyl or ethyl), G is H or $C_{1-6}$ alkyl, and R' is selected from $C_{7-23}$ alkyl or alkenyl (e.g., $C_{7-19}$ alkyl or alkenyl, or $C_{9-19}$ alkyl or alkenyl).

In some embodiments, the one or more fatty acid alkanolamide compounds have a structure according to formula (II):

II

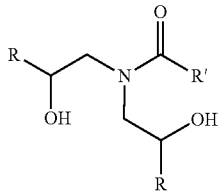

wherein R is H or $C_{1-12}$ alkyl (such as $C_{1-8}$ alkyl or $C_{1-4}$ alkyl, e.g., methyl or ethyl), and R' is selected from $C_{7-23}$ alkyl or alkenyl (e.g., $C_{7-19}$ alkyl or alkenyl, or $C_{9-19}$ alkyl or alkenyl). In some embodiments, at least one fatty acid alkanolamide is a compound of formula (I) or (II) wherein R is selected from $C_{1-12}$ alkyl, such as $C_{1-8}$ alkyl or $C_{1-4}$ alkyl, e.g., methyl or ethyl. Exemplary fatty acid alkanolamides of formulas (I) and (II), suitable mixtures of such alkanolamides, and methods of preparing the same are found in U.S. Pat. No. 9,562,207 and US 2016/0251591, which are incorporated herein by reference.

$C_{7-23}$ alkyl or alkenyl (e.g., $C_{7-19}$ alkyl or alkenyl, or $C_{9-19}$ alkyl or alkenyl) represents a straight or branched chain of the designated number of carbon atoms, which is fully saturated in the case of alkyl or contains one or more carbon-carbon double bonds in the case of alkenyl.

$C_{1-6}$ alkyl and $C_{1-12}$ alkyl (such as $C_{1-8}$ alkyl or $C_{1-4}$ alkyl) represent a straight or branched fully saturated chain of the designated number of carbon atoms, e.g., methyl, ethyl, propyl, isopropyl, butyl, sec-butyl, iso-butyl, tert-butyl, pentyl, sec-pentyl, tert-pentyl, hexyl, methylpentyl, ethyl butyl, etc.

The two R groups in formula (I) (where n is 2) or formula II may be the same or different. For example, each R may be independently selected from H, methyl, ethyl, propyl, isopropyl, butyl, sec-butyl, iso-butyl and tert-butyl. In some embodiments R is methyl or ethyl. In certain embodiments, each R is methyl.

In many embodiments, a mixture of alkanolamides is used. For example, a mixture of compounds of formula I or formula II differing at R' may be employed. In such mixtures, for example, at least one compound of formula I or II where R' is $C_{15}$ alkyl or alkenyl and at least one compound of formula I or II where R' is $C_{17}$ alkyl or alkenyl may be present. In some embodiments the majority of R' groups in the mixture are selected from $C_{13}$, $C_{15}$ and $C_{17}$ alkyl or alkenyl (which correlate with products derived from $C_{14}$, $C_{16}$ and $C_{18}$ fatty acids), for example, in some embodiments, the majority of R' groups in the mixture are $C_{15}$ and/or $C_{17}$ alkyl or alkenyl. In many embodiments, both alkyl and alkenyl groups are present at R' in the amide mixtures.

There are variety of natural sources for the carboxylic acid or derivative used in the preparation of the alkanolamides, e.g., fats and oils, such as canola oil, corn oil, coconut oil, sunflower oil, soybean oil, lard, palm oil, beef tallow, cocoa butter, illipe, which provide mixtures of carboxylic acids and derivatives. The carboxylic acids or carboxylic acid derivatives may be reacted with a di(hydroxyalkyl) amine. U.S. Pat. No. 9,562,207 has shown particular value in preparing friction reducing alkanolamides from bis(2-hydroxypropyl)amine and methyl esters derived from beef tallow carboxylates, and these amides work exceedingly well in the present disclosure. Other alkanolamides from other carboxylates or mixtures of carboxylates similarly provide excellent benefits when blended with the molybdenum based lubricating oil additive according to the instant disclosure.

The carboxylate groups of fats and oils are often present as esters. For example, beef tallow contains esters, such as glycerides, diglycerides, triglycerides etc., of palmitic acid (saturated $C_{16}$ acid), stearic acid (saturated $C_{18}$ acid), oleic acid (mono-unsaturated $C_{18}$ acid) and smaller amounts of poly-unsaturated $C_{18}$ acids and other fatty acids. Thus, using beef tallow as the source of the alkylcarboxy portion of the alkanolamides provides a mixture of predominately palmitic, stearyl and oleic amides, i.e., compounds of formula II wherein R' is $C_{15}$ alkyl, $C_{17}$ alkyl and $C_{17}$ alkenyl.

It is possible to use the natural source as it is obtained, for example, a mixture of glycerides, or the natural mixture of products can be hydrolyzed to a fatty acid mixture or otherwise transformed, e.g., transesterified with a smaller alcohol, prior to use. For example, a tallow triglyceride can be reacted with methanol to provide a mixture of methyl tallowate esters which can be reacted with the desired amine; the tallow triglyceride can be hydrolyzed to a tallow acid mixture and then reacted with the amine; or the triglyceride can be directly reacted with amine. Each of these methods can be used to prepare the same, or roughly the same amide mixture, however, processing conditions and side products will vary.

In some embodiments, the mixture of alkanolamides of the present disclosure comprises compounds of formula I or II wherein about 15 to about 45% by weight of the alkanolamides are compounds where R' is $C_{15}$ alkyl or alkenyl, about 40 to about 80% by weight of the alkanolamides are compounds where R' is $C_{17}$ alkyl or alkenyl, and 0 to about 15%, or 2 to 15%, by weight of the alkanolamides are compounds where R' is $C_{7-14}$, $C_{16}$ or $C_{18-19}$ alkyl or alkenyl;

for example, wherein about 20 to about 35% by weight of the alkanolamides are compounds where R' is $C_{15}$ alkyl or alkenyl, about 50 to about 75% by weight of the alkanolamides are compounds where R' is $C_{17}$ alkyl or alkenyl, and 0 to about 15%, or 2 to 15%, by weight of the alkanolamides are compounds where R' is $C_{7-14}$, $C_{16}$ or $C_{18-19}$ alkyl or alkenyl, in some embodiments, 0 or 2 to about 15% by weight of the alkanolamides are compounds where R' is $C_{9-14}$, $C_{16}$ or $C_{18-19}$ alkyl or alkenyl.

In some embodiments, about 30 to about 70% by weight of the alkanolamides are compounds where R' is $C_{7-19}$ alkyl and about 30 to about 70% by weight are compounds where R' is $C_{7-19}$ alkenyl.

In some embodiments, the mixture of amides comprises compounds of formula I or II wherein about 15 to about 45%, for example, about 20 to about 35%, by weight of the alkanolamides are compounds where R' is $C_{15}$ alkyl or alkenyl wherein a majority, for example, about 75% or more, 90% or more, or 95% or more of the $C_{15}$ alkyl or alkenyl are alkyl;

about 40 to about 80%, for example, about 50 to about 75%, by weight of the alkanolamides are compounds where R' is $C_{17}$ alkyl or alkenyl, wherein about 40 to about 95% of said $C_{17}$ alkyl or alkenyl are alkenyl; and 0 to about 15% by weight (e.g., 1 to about 15% by weight) of the alkanolamides are compounds where R' is $C_{7-14}$, $C_{16}$ or $C_{18-19}$ alkyl or alkenyl, for example, $C_{9-14}$, $C_{16}$ or $C_{18-19}$ alkyl or alkenyl.

In some embodiments, about 15 to about 45% of the alkanolamides are compounds wherein R' is fully saturated $C_{15}$ alkyl, and a portion of the alkanolamides are compounds where R' as $C_{17}$ are saturated alkyl and a portion are alkenyl. In many embodiments about 20 to about 35% by weight of the alkanolamides are compounds wherein R' is fully saturated $C_{15}$ alkyl and both $C_{17}$ alkyl and $C_{17}$ alkenyl as R' are present.

The molybdenum based friction reducing additive of the present disclosure may be prepared according to known methods. The molybdenum additive may comprise a mixture of molybdenum based compounds.

In some embodiments, the molybdenum based friction reducing additive comprises one or more compounds of the formula $Mo(ROCS_2)_4$ and/or the formula $Mo(RSCS_2)_4$, wherein R is an organo group selected from the group consisting of alkyl, aryl, aralkyl and alkoxyalkyl, generally of from 1 to 30 carbon atoms, such as 2 to 12 carbon atoms, e.g., alkyl of 2 to 12 carbon atoms.

In some embodiments, the molybdenum based friction reducing additive comprises one or more molybdenum dithiocarbamates.

One example of suitable molybdenum dithiocarbamates is represented by the formula:

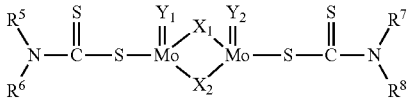

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$, or $C_{3-6}$ hydrocarbyl group) containing (e.g., terminating in) an ester, ether, alcohol, amine, amide or carboxyl group; and $X_1$, $X_2$, $Y_1$, and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group. In some embodiments, $R^5$, $R^6$, $R^7$, and $R^8$ are each independently chosen from a $C_{3-12}$ hydrocarbyl group terminating in a $C_{9-19}$ (e.g., $C_{13-17}$) alkyl or alkenyl ether or amide. In some embodiments, at least two of the four R groups are the same. In some embodiments, $R^5$ and $R^8$ are the same and $R^6$ and $R^7$ are the same. In some embodiments, each R is the same.

In further embodiments, at least one R (e.g., $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$alkyl or alkenyl ether, and at least one other R (e.g., the other of $R^5$ and $R^8$ or $R^8$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl amide.

Other examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl, $R^5$, $R^6$, $R^7$, and $R^8$ may each have $C_5$ to $C_8$ alkyl groups. $X_1$ and $X_2$ may be the same, and $Y_1$ and $Y_2$ may be the same. For example, $X_1$ and $X_2$ may both comprise sulfur atoms, and $Y_1$ and $Y_2$ may both comprise oxygen atoms.

Further examples of molybdenum dithiocarbamates include $C_6$-$C_{18}$ dialkyl or diaryldithiocarbamates, or alkylaryldithlocarbamates, such as dibutyl-, diamyl-di-(2-ethylhexyl)-, dilauryl-, dioleyl-, and dicyclohexyl-dithiocarbamate.

Additional examples of suitable molybdenum dithiocarbamates are represented by the following dinuclear and trinuclear formulas, respectively:

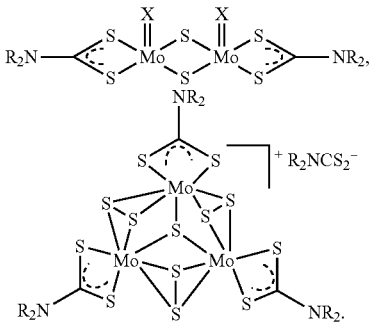

In the dinuclear formula, X may be oxygen or sulfur. In both formulas, R may be $C_{1-20}$ alkyl or alkenyl, or $C_{6-20}$ cycloalkyl, aryl, alkylaryl, or aralkyl. Exemplary R groups include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. Each R group may, but need not be, the same.

Another example of suitable molybdenum dithiocarbamates is represented by the formula:

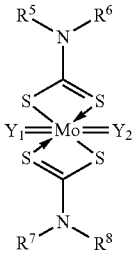

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$ or $C_{3-6}$ hydrocarbyl group) containing (e.g., terminating in) an ester, ether, alcohol, amine, amide or carboxyl group; and $Y_1$ and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group. In some embodiments, $R^5$, $R^6$, $R^7$, and $R^8$ are each independently chosen from a $C_{3-12}$ hydrocarbyl group terminating in a $C_9$-19 (e.g., $C_{13-17}$) alkyl or alkenyl ether or amide. In some embodiments, at least two of the four R groups are the same. In some embodiments, $R^5$ and $R^8$ are the same and $R^6$ and $R^7$ are the same. In some embodiments, each R is the same.

In further embodiments, at least one R (e.g., $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl ether, and at least one other R (e.g., the other of $R^5$ and $R^8$ or $R^6$ and $R^7$) is a $C_{3-20}$ hydrocarbyl group (e.g., $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl amide.

Other examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl, $R^5$, $R^6$, $R^7$, and $R^8$ may each have $C_6$ to $C_{18}$ alkyl groups. $Y_1$ and $Y_2$ may be the same, i.e., $Y_1$ and $Y_2$ may both comprise oxygen atoms or both comprise sulfur atoms.

A further example of suitable molybdenum dithiocarbamates is represented by the formula:

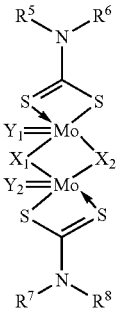

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$ or $C_{3-6}$ hydrocarbyl group) containing (e.g., terminating in) an ester, ether, alcohol, amine, amide or carboxyl group; and $X_1$, $X_2$, $Y_1$, and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group. In some embodiments, $R^5$, $R^6$, $R^7$, and $R^8$ are each independently chosen from a $C_{3-12}$ hydrocarbyl group terminating in a $C_{9-19}$ (e.g., $C_{13-17}$) alkyl or alkenyl ether or amide. In some embodiments, at least two of the four R groups are the same. In some embodiments, $R^5$ and $R^8$ are the same and $R^6$ and $R^7$ are the same. In some embodiments, each R is the same.

In further embodiments, at least one R (e.g., $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl ether, and at least one other R (e.g., the other of $R^5$ and $R^8$ or $R^6$ and $R^7$) is a $C_{3-20}$ hydrocarbyl group (e.g., a $C_{3-12}$ or $C_{3-6}$ hydrocarbyl group)

containing (e.g., terminating in) a $C_{1-30}$, $C_{5-25}$, $C_{9-19}$, or $C_{13-17}$ alkyl or alkenyl amide.

Other examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, dodecyl, tridecyl, lauryl, oleyl, linoleyl, cyclohexyl and phenylmethyl. $R^5$, $R^6$, $R^7$, and $R^8$ may each have $C_6$ to $C_{18}$ alkyl groups, $X_1$ and $X_2$ may be the same, and $Y_1$ and $Y_2$ may be the same. For example, $X_1$ and $X_2$ may both comprise sulfur atoms, and $Y_1$ and $Y_2$ may both comprise oxygen atoms.

In some embodiments, the molybdenum based lubricating oil additive is the reaction product of:

(a) an unsaturated or saturated ester or acid;

(b) a diamine of the formula

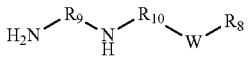

wherein $R_8$ is an alkyl group of 1 to 40 carbon atoms, $R_9$ and $R_{10}$ are independently selected aliphatic or aromatic moieties, and W is oxygen, sulfur, or —$CH_2$—;

(c) carbon disulfide; and (d) a molybdenum compound, such as molybdic acid, ammonium molybdate, molybdenum salts, such as $MoOCl_4$, $MoO_2Br_2$, $Mo_2O_3Cl_6$, and $MoO_3$, and their thio analogues, such as $MoS_3$ and $(NH_4)_2MoS_4$.

The unsaturated or saturated ester or acid may be a mono- or polyfunctional organic acid or ester of the formula:

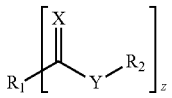

wherein $R_1$ is a straight chain or branched chain or cyclic, saturated or unsaturated, hydrocarbon moiety of 1 to 44, e.g., 1 to 19, carbon atoms, $R_2$ is hydrogen, a hydrocarbon radical, or a functionalized hydrocarbon radical, typically having 1 to 18 carbon atoms, Z is an integer of 1 to 5, e.g., 1 to 4, and X and Y are independently selected from the group consisting of sulfur and oxygen.

In some embodiments, $R_1$ is a straight or branched chain, fully saturated or partially unsaturated hydrocarbon moiety of 1 to 44 carbon atoms. For example, $R_1$ may be methyl, ethyl, propyl, butyl, pentyl, hexyl, 2-ethyl hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof. Additionally, contained within the chains of $R_1$ may be ester groups or heteroatoms, such as oxygen and sulfur, which may take the form of ethers, poly ethers, and/or sulfides.

Natural materials may be conveniently employed in the preparation of the molybdenum additive, e.g., mono-, di-, and tri-glycerides from fats and oils, such as vegetable oils may be used, which are themselves typically mixtures lending to the complexity of the product mixture.

In one aspect, the preparation of the molybdenum based lubricating oil additive begins with the reaction of a carboxylic acid or ester with a diamine, typically in a molar ratio of, e.g., 1:2 to 2:1 of amine to acid/ester, often at elevated temperature, e.g., from 90 to 200° C. To the product formed is added $CS_2$, and then the molybdenum compound, e.g., $MoO_3$, followed by heating if necessary, e.g., from 70 to 140° C.

Additional detail can be found in, e.g., U.S. Pat. No. 6,103,674. U.S. Pat. No. 6,103,674 is incorporated herein by reference for its disclosure of molybdenum based friction reducing additives and methods of preparing the same.

Carboxylic acids that can be used in the production of a molybdenum based additive suitable for the present disclosure include $C_{2-45}$, e.g., $C_{2-24}$, $C_{6-20}$, or $C_{8-18}$, straight chain, branched chain or cyclic alkanoic or alkenoic mono-, di- tri-, or tetra-carboxylic acids, which may be substituted by OH or interrupted by oxygen. For example, some mono-carboxylic acids useful in the disclosure include acetic, propionic, butyric, pentanoic, hexanoic, heptanoic, ethylhexanoic, octanoic, nonanoic, decanoic, dodecanoic, myristic, palmitic, stearic, arachidonic, and unsaturated analogues, such as hexenoic, decanoic, myristoleic, oleic, linoleic, and the like. Useful di-carboxylic acids include, e.g., malonic, succinic, glutaric, adipic, pimelic, suberic, azelaic, sebacic, and the like.

Useful esters include esters based on the preceding acids with $C_{1-45}$, e.g., $C_{1-12}$ or $C_{1-4}$, straight chain, branched chain or cyclic, alkyl or alkenyl alcohols, diols, triols, or tetrols, pentols or hexols, including ether containing alcohols, such as diethylene glycol.

For example, some useful esters include methyl, ethyl, propyl, iso-propyl, butyl, iso-butyl, t-butyl, pentyl, hexyl, 2-ethyl hexyl, heptyl, octyl, nonyl, decyl, undecyl, dodecyl, tetradecyl, hexadecyl, octadecyl or oleyl esters of the acids above, e.g., methyl, ethyl, propyl, iso-propyl, butyl, iso-butyl, t-butyl esters. Useful esters from polyols include those formed from the acids above and diols, such as ethylene glycol or propanediol, triols, such as glycerol, or tetrols, such as pentaerythritol.

More than one carboxylic acid or ester may be used, and in some embodiments, carboxylic acids and esters are used.

In one embodiment, a vegetable oil is used as the source of the carboxylic acid and or esters. Vegetable oils generally contain a mixture of triglycerides. Naturally occurring vegetable oils include, e.g., canola oil, corn oil, coconut oil, sunflower oil, soybean oil, lard, palm oil, etc. For example, canola oil comprises a mixture of esters comprising as the alcohol portion glycerol, and as the carboxylic acid portion oleic acid, linoleic acid and smaller quantities of palmitic and stearic acid.

Certain specific esters useful in preparing suitable molybdenum additives include but are not limited to ethylene glycol dioleate, propylene glycol dioleate, butanediol dioleate, glycerol monooleate, glycerol linoleate, glycerol linolenate, glycerol trioleate, pentaerythritol tetraoleate, pentaerythritol trioleate monomyristate, trimethylol propane trioleate, trimethylol propane dioleate monomyristate, trimethylol propane dilinoleate monooleate, and the like, and dibasic esters, such as dioleyl adipate, dioleyl sebacate, dioleyl maleate, dioleyl succinate, dilinoleyl adipate, and the like. Mixtures of such esters, and others similar thereto, are also useful.

The above acids and/or esters may be reacted with one or more amines, such as amines exemplified by the formula:

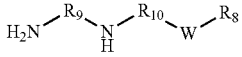

wherein $R_8$ is an alkyl group of 1 to 40 carbon atoms, $R_9$ and $R_{10}$ are independently selected aliphatic or aromatic moieties, and W is oxygen, sulfur, or —$CH_2$—. The diamine may be used in a concentration of about 10 weight percent to about 70 weight percent.

$R_8$ can be an alkyl moiety of 1 to 40, e.g., 8 to 24, carbon atoms and can have either a straight chain or a branched chain, a fully saturated or partially unsaturated hydrocarbon chain, e.g., methyl, ethyl, propyl, butyl, pentyl, hexyl, 2-ethyl hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof. Additionally, $R_8$ can contain within its chain ester groups or heteroatoms, such as oxygen and sulfur which can take the form of ethers, polyethers, and/or sulfides.

$R_9$ and $R_{10}$ in the above formula, independently, can be aliphatic or aromatic moieties, generally aliphatic, e.g., alkylene, such as ethylene, propylene, or isopropylene. In many embodiments, $R_9$ and $R_{10}$ are independently selected from the group consisting of ethylene and propylene, and often $R_9$ and $R_{10}$ are each propylene.

Some polyamines useful in the present disclosure are commercially available, including, e.g.:

octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, and N-oleyl-1,3-diaminopropane.

The product from the acid and/or ester and amine above can be reacted with carbon disulfide and then a molybdenum compound (e.g., molybdenum trioxide). The molybdenum compound may be used in a concentration of, e.g., about 0.01 to about 15 wt %.

For example, in some embodiments, the molybdenum based lubricating oil friction reducing additive is the reaction product of (a) a vegetable oil; (b) a diamine comprising octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane; (c) carbon disulfide; and (d) $MoO_3$.

Additional examples of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds, such as water, amines, alcohols, phosphines, and ethers, and z ranges from 0 to 5 and includes non-stoichiometric values. At least 21 total carbon atoms may be present among all the ligands' organo groups, or at least 25, at least 30, or at least 35 carbon atoms. Additional suitable molybdenum compounds are described in U.S. Pat. No. No. 6,723,685.

In some embodiments, the molybdenum friction reducing additive comprises one or more molybdenum dithiophosphates.

One example of suitable molybdenum dithiophosphates is represented by the formula:

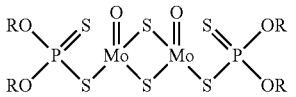

wherein R is $C_1$ to $C_{20}$ alkyl or alkenyl (e.g., $C_6$ to $C_{18}$ alkyl or alkenyl). Examples of suitable groups for R include 2-ethylhexyl, nonylphenyl, methyl, ethyl, n-propyl, isopropyl, n-butyl, t-butyl, n-hexyl, n-octyl, nonyl, decyl, dodecyl, tridecyl, lauryl, oleyl, and linoleyl. In some embodiments, the molybdenum species are bridged.

Further examples of molybdenum compounds which may be used include commercial materials sold as Molyvan® 822, Molyvan® A, Molyvan® L, Molyvan® 2000, and Molyvan® 855, Adeka Sakura-Lube® S-100, S-165, S-200, S-300, S-310G, S-525, S-600, S-700, and S-710, ADDITIN® RC 3580, and mixtures thereof.

In a further embodiment, a lubricant composition comprises a lubricating oil and a friction reducing effective amount of the friction reduction additive composition described herein. For example, the lubricant composition may comprise a lubricating oil, the molybdenum based lubricating oil friction reducing additive, and the one or more fatty acid alkanolamide compounds, wherein the weight ratio of the molybdenum additive to the alkanolamides in the lubricant composition is from 4:1 to 1:4, from 3:1 to 1:3, from 2.5:1 to 1:2.5, from 2:1 to 1:2, from 1.5:1 to 1:1.5, or 1:1, e.g., from 1:1 to 1:5, such as 1:1.1 to 1:5, 1:1.2 to 1:4, 1:1.5 to 1:4, or 1:1.5 to 1:3. In some embodiments, the lubricant composition comprises from about 0.3 to about 3.0 wt % of the friction reduction additive composition of the present disclosure, based on the total weight of the lubricant composition, e.g., 0.3 to 1.5, 0.5 to 2, 0.5 to 1.5, 0.5 to 1, 1 to 2, or 1 to 3 wt %, based on the total weight of the lubricant composition.

Also disclosed is a method of formulating a lubricant composition or improving the friction reduction performance of a lubricant composition. The method comprises providing a lubricating oil comprising one or more naturally occurring base stocks or synthetic base stocks, and adding to the lubricating oil a friction reduction additive composition according to the present disclosure. The one or more fatty acid alkanolamides and the molybdenum based lubricating oil friction reducing additive of the presently disclosed friction reduction composition may be added individually (i.e., as separate components) to the lubricating oil or may be added collectively (i.e., as a mixture or blend) to the lubricating oil. As will be understood in the art, the one or more fatty acid alkanolamides and the molybdenum based friction reducing additive can be part of an additive package for treating the one or more base stocks. It is also possible to top treat the lubricant composition.

In another aspect, a method of lubricating an internal combustion engine comprises supplying to the engine a lubricant composition according to the present disclosure.

Commercial lubricant formulations typically contain a variety of other additives, for example, dispersants, detergents, corrosion/rust inhibitors, antioxidants, other anti-wear agents, anti-foamants, other friction modifiers, seal swell agents, demulsifiers, V.I. improvers, pour point depressants, and the like. A sampling of these additives can be found in, for example, U.S. Pat. Nos. 5,498,809 and 7,696,136, the relevant portions of each disclosure is incorporated herein by reference, although the practitioner is well aware that this comprises only a partial list of available lubricant additives. It is also well known that one additive may be capable of providing or improving more than one property, e.g., an anti-wear agent may also function as an anti-fatigue and/or an extreme pressure additive.

The lubricant compositions of the present disclosure will often contain any number of these additives. Thus, final lubricant compositions of the instant disclosure will generally contain a combination of additives, including the inventive friction modifying additive combination along with other common additives, in a combined concentration ranging from about 0.5 to about 30 weight percent, e.g., from about from about 0.5 to about 10 or 15 weight percent based on the total weight of the oil composition. For example, the combined additives are present from about 1 to about 5 or 10 weight percent.

Given the ubiquitous presence of additives in a lubricant formulation, the amount of lubricating oil present in the inventive composition is not specified above, but in most embodiments, except additive concentrates, the lubricating oil is a majority component, i.e., present in more than 50 wt % based on the weight of the composition, for example, 60 wt % or more, 70 wt % or more, 80 wt % or more, 90 wt % or more, or 95 wt % or more.

In one embodiment, a lubricant composition comprises a) from about 70 to about 99.9 wt % of a natural or synthetic lubricating oil base stock, b) from about 0.05 to about 5 wt % based on the total weight of the lubricant composition, of the friction reduction additive composition above, and c) one or more additional lubricant additives selected from the group consisting of dispersants, detergents, corrosion/rust inhibitors, antioxidants, other anti-wear agents, anti-foamants, other friction modifiers, seal Swell agents, demulsifiers, V.I. improvers and pour point depressants, wherein the combined amount of b) and c) present in the composition is from about 0.1 to about 30 weight percent based on the total weight of the lubricant composition. In another embodiment the lubricating oil base stock is present in the lubricant composition from about 90 to about 99.5 wt % of the composition and the combined amount of b) and c) is from about 0.5 to about 10 weight percent; and in some embodiments the base stock is present from about 95 to about 99 wt % and the combined amount of b) and c) is from about 1 to about 5 weight percent based on the total weight of the lubricant composition.

In another embodiment, a lubricant composition comprises a) from about 70 to about 99.5 wt % of a natural or synthetic lubricating oil base stock, b) from about 0.3 to about 3 wt % based on the total weight of the lubricant composition, of the friction reduction additive composition above, and c) one or more additional lubricant additives selected from the group consisting of dispersants, detergents, corrosion/rust inhibitors, antioxidants, other anti-wear agents, anti-foamants, other friction modifiers, seal Swell agents, demulsifiers, V.I. improvers and pour point depressants, wherein the combined amount of b) and c) present in the composition is from about 0.5 to about 30 weight percent based on the total weight of the lubricant composition. In another embodiment, the lubricating oil base stock is present in the lubricant composition from about 75 to about 90 wt % of the composition and the combined amount of b) and c) is from about 10% to about 25%.

The natural or synthetic lubricating oil of the invention can be any suitable oil of lubricating viscosity as described for example in co-pending U.S. application Ser. No. 12/371,872, the relevant portions of which are incorporated herein by reference. For example, a lubricating oil base stock is any natural or synthetic lubricating oil base stock, or mixtures thereof, having a kinematic viscosity at 100° C. of about 2 to about 200 cSt, about 3 to about 150 cSt, and often about 3 to about 100 cSt. Suitable lubricating oil base stocks include, for example, mineral oils, such as those derived from petroleum, oils derived from coal or shale, animal oils, vegetable oils and synthetic oils. The relevant portions of co-pending U.S. application Ser. No. 12/371,872 are incorporated herein by reference.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of alphaolefins and dicarboxylic acids which are esterified with short or medium chain length alcohols.

The synthetic oils may comprise at least one of an oligomer of an α-olefin, an ester, an oil derived from a Fischer-Tropsch process, and a gas-to-liquid stock. Synthetic base stock lubricating oils include hydrocarbon oils and halo-substituted hydrocarbon oils, such as polymerized and interpolymerized olefins (e.g., polybutylenes, polypropylenes, propylene-isobutylene copolymers, chlorinated polybutylenes, poly(1-hexenes), poly(1 octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process.

In many embodiments, the oil base stock comprises mineral oils. For example, the lubricating oil of the invention may be a petroleum oil, or a mixture comprising a petroleum oil. Many other embodiments include vegetable oils, paraffinic oils, naphthenic oils, aromatic oils, and derivatives thereof, often as combination of base stocks.

Useful base stocks from vegetable and animal sources include, for example, alkyl esters of fatty acids, which include commercial mixtures of the ethyl, propyl, butyl and especially methyl esters of fatty acids with 12 to 22 carbon atoms. For example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid are useful and have an iodine number from 50 to 150, especially 90 to 125. Mixtures with particularly advantageous properties are those which contain mainly, i.e., at least 50 wt. %, methyl esters of fatty acids with 16 to 22 carbon atoms and 1, 2, or 3 double bonds. The preferred lower alkyl esters of fatty acids are the methyl esters of oleic acid, linoleic acid, linolenic acid, and erucic acid.

Often the base stock of lubricating viscosity can comprise a Group I, Group II, or Group III base stock or base oil blends of the aforementioned base stocks, for example, the oil of lubricating viscosity is a Group II or Group III base stock, or a mixture thereof, or a mixture of a Group I base stock and one or more of a Group II and Group III. Generally, a major amount of the oil of lubricating viscosity is a Group II, Group III, Group IV, or Group V base stock, or a mixture thereof. The base stock, or base stock blend, typically has a saturate content of at least 65%, e.g., at least 75% or at least 85%. Most preferably, the base stock, or base stock blend, has a saturate content of greater than 90%.

Definitions for the base stocks and base oils in this invention are the same as those found in the American Petroleum Institute (API) publication "Engine Oil Licensing and Certification System," Industry Services Department (14th ed., December 1996), Addendum 1, December 1998. This publication categorizes base stocks as follows.

(a) Group I base stocks contain less than 90 percent saturates (as determined by ASTM D 2007) and/or greater than 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(b) Group II base stocks contain greater than or equal to 90 percent saturates (as determined by ASTM D 2007) and less than or equal to 0.03 percent sulfur (as determined by ASTM D 2622, ASTM D 4294, ASTM D 4927, and ASTM D 3120) and have a viscosity index greater than or equal to 80 and less than 120 (as determined by ASTM D 2270).

(c) Group III base stocks contain greater than or equal to 90 percent saturates (as determined by ASTM D 2007) and less than or equal to 0.03 percent sulfur (as determined by ASTM D 2622, ASTM D 4294, ASTM D 4927, and ASTM D 3120) and have a viscosity index greater than or equal to 120 (as determined by ASTM D 2270).

(d) Group IV base stocks are polyalphaolefins (PAO).

(e) Group V base stocks include all other base stocks not included in Groups I, II, III, or IV.

The lubricating oil compositions of the present disclosure can be used in a variety of applications, for example, crankcase lubricating oils for spark-ignited and compression-ignited internal combustion engines, gas engine lubricants, turbine lubricants, automatic transmission fluids, gear lubricants, compressor lubricants, metal-working lubricants, hydraulic fluids, and other lubricating oil and grease compositions.

Further non-limiting disclosure is provided in the Examples that follow.

EXAMPLES

The below-discussed results surprisingly show a synergistic effect of the organic amide friction modifier of the invention as co-additive for select MoFMs as described herein, which allows one to achieve outstanding friction reduction for an exceptionally long period of time at, e.g., greatly reduced molybdenum levels.

Example 1

The improvements of one embodiment of the invention are illustrated in the data from tribology testing using additive formulations in 0W-20 motor oil. These very low viscosity oils place great demands on friction reducers and anti-wear agents. Specific tribological experiments were designed to evaluate the durability and performance retention of these formulations under isothermal conditions at 160° C. in order to simulate oil aging and higher mileage, and demonstrated a clear, unexpected combined synergy of the system. The exceptional friction reduction synergy exhibited by the inventive additive composition can provide major benefits in formulating, e.g., passenger car motor oils targeting lower viscosities formulations to improve fuel economy.

Oil formulations were prepared using a 0W-20 motor oil without any friction modifier but containing all other additives. The molybdenum based lubricating oil additive was prepared according to the process of U.S. Pat. No. 6,103,674 from canola oil, a long chain ether containing diamine of the formula described herein, carbon disulfide and molybdenum trioxide. The alkanolamide was a mixture of alkanolamides of formula II wherein R was methyl and about 15 to about 45% by weight of the alkanolamides were compounds where R' is $C_{15}$ alkyl or alkenyl, about 40 to about 80% by weight of the alkanolamides were compounds where R' is $C_{17}$ alkyl or alkenyl, and 1 to about 15% by weight of the alkanolamides were compounds where R' was $C_{7-14}$, $C_{16}$ or $C_{18-19}$ alkyl or alkenyl, prepared according to the process of U.S. Pat. No. 9,562,207 using di-iso-propanolamine and methyl tallowate.

Three lubricant compositions were prepared, a first comprising the 0W-20 oil and 1 wt %, based on the weight of the composition, of the molybdenum based lubricating oil additive (M), a second comprising the 0W-20 oil and 1 wt % of the alkanolamide mixture (A), and a third comprising the 0W-20 oil and 1 wt % of a 1:1 weight ratio mixture of the molybdenum based lubricating oil additive to alkanolamide (AM).

FIG. 1 shows the results of tribology testing where the coefficient of friction was measured over time at 160° C. (isothermal testing) for line contact dowel pin sliding on a flat surface. For all line contact measurements discussed herein the specimens consisted of a 16-mm long nitride steel dowel pin (6 mm diameter, RC hardness 60) rubbed against a hardened ground steel plate (RC hardness 60). The measurements were made with 100 N load at 1.75 Hz frequency and 4.5 mm amplitude stroke length. The sample comprising 1.0% of the molybdenum additive (M) initially showed greater friction reduction performance than 1.0% of the alkanolamide (A). However, after 20 hrs the CoF of the 1 wt % molybdenum additive sample (M) rises above the 1 wt % alkanolamide sample (A) and levels off, remaining above the alkanolamide. However, the formulation comprising 1 wt % of the 1:1 molybdenum additive/alkanolamide combination (0.5% molybdenum additive plus 0.5% alkanolamide) (AM) showed a synergistic effect, providing great improvement over the use of either molybdenum additive or alkanolamide alone. As shown, the lubricant composition of the invention exhibited excellent friction reduction performance initially and maintained superior friction reduction performance compared to either of the molybdenum or alkanolamide formulations alone for the duration of the testing.

Example 2

In another test series, other motor oils, e.g., 5W-30 oils, and various weight ratios of the molybdenum additive and alkanolamide components, which were prepared as in Example 1, were evaluated for friction reduction activity and durability in performance using, e.g., line Cameron Plint TE-77 tribology testing (COF vs. Temperature) and Mini-Traction-Machine (MTM) ball-on-disc point contact Stribeck curve studies at isothermal temperatures 150C, to test for performance at lower levels of molybdenum.

The additive composition of the invention showed improvements in friction reduction above the mathematical performance average of the individual friction modifiers alone. The table below shows the Coefficient of Friction from Cameron Plint TE-77 tribology testing for 5W-30 oil formulations containing 1 wt % of commercial Molybdenum Friction Modifiers, COM-MOFM1 and COM-MOFM2, 1 wt % of the MoFM prepared according to Example 1, and 1 wt % of a 3:1 mixture of the alkanolamide to MoFM (each prepared according to Example 1). COM-MOFM1 (a commercially available di-molybdenum dithiocarbamate) was a friction reduction additive of approximately 5 wt % Mo by composition. COM-MOFM2 (a commercially available non-sulfur containing organo-molybdenum complex) was a friction reduction additive of approximately 8 wt % Mo by composition. The MoFM additive prepared according to Example 1 and used in the present Example contained ~4 wt % Mo, which was reduced further by blending with the alkanolamide. Also listed in the table below is the concentration of molybdenum in the respective oil formulations.

Cameron Flint TE-77 CoF vs. Temperature

| | 60° C. | 90° C. | 120° C. | 160° C. | Conc. of Mo in the resulting oil formulation |
|---|---|---|---|---|---|
| 1 wt % COM-MOFM1 | 0.12 | 0.11 | 0.075 | 0.055 | ~0.05 wt % |
| 1 wt % COM-MOFM2 | 0.10 | 0.095 | 0.095 | 0.075 | ~0.08 wt % |
| 1 wt % 3:1 Amide:Mo (INV) | 0.085 | 0.075 | 0.070 | 0.055 | ~0.01 wt % |
| 1 wt % Mo (EXP) | 0.090 | 0.090 | 0.075 | 0.035 | ~0.04 wt % |

The data shows that the performance of the combination was better at low temperatures than the molybdenum alone, and approaches the same level of friction reduction at 160C. This mixture resulted in lower levels (down to 0.01%) of Molybdenum in the oil formulation (i.e., a 1 wt % total load of the combined additive composition, 0.25 wt % of which was the molybdenum friction modifier additive which contained approximately 4 wt % molybdenum). Thus, at the same total load levels (1 wt %) in the oil formulations, the tribology results demonstrate the excellent performance of the exemplary inventive composition, which used significantly less Mo (~0.01 wt % concentration of Mo in the lubricant composition in this Example).

Figure 2:
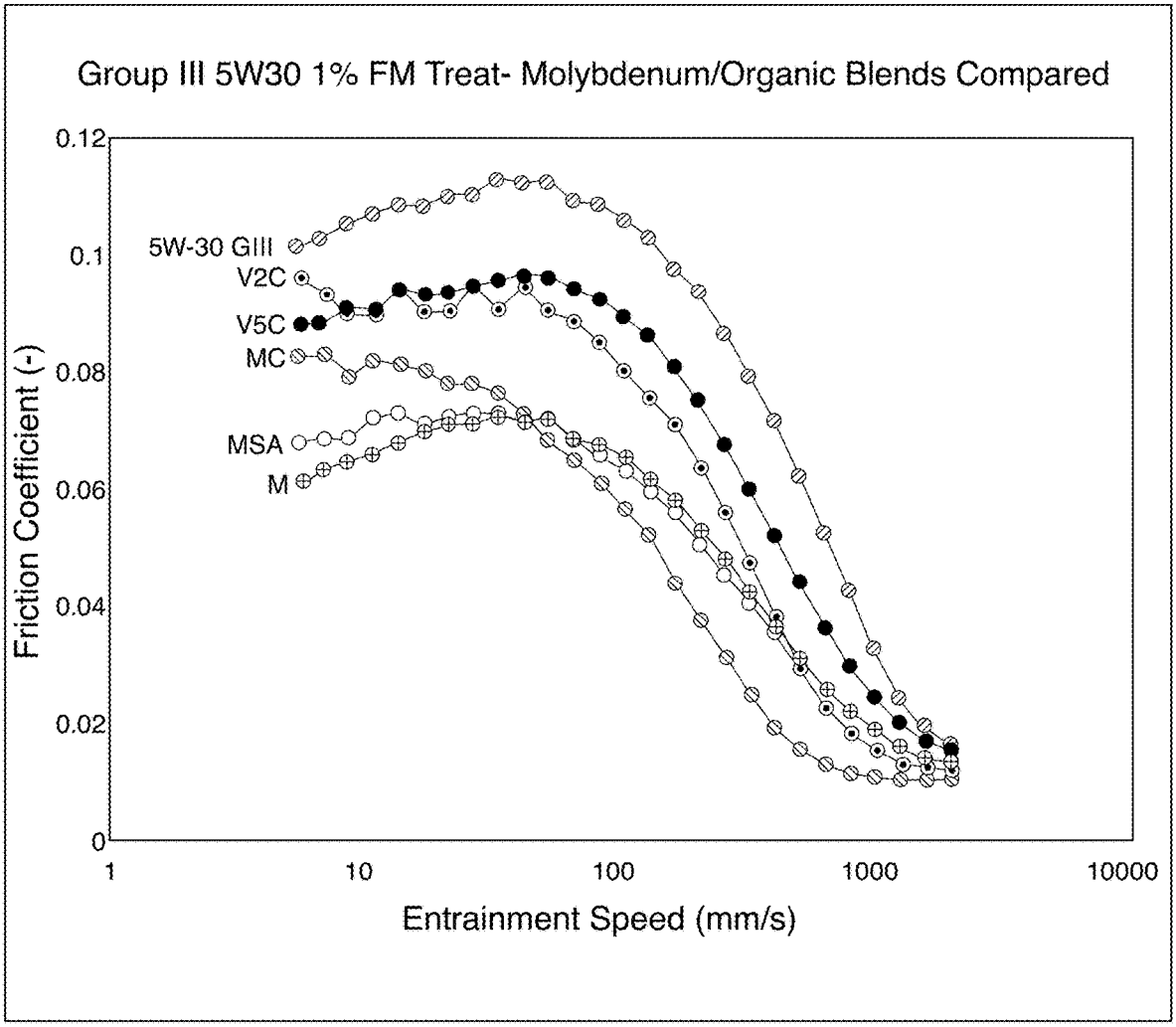
FIG. 2 is a chart showing Stribeck curves obtained from lubricant compositions comprising several additive blends.

FIG. 2 shows the Mini-Traction-Machine Stribeck curves obtained for 5W-30 oil formulations evaluated for boundary lubrication in the Flint TE-77 Cameron Flint friction experiment where the coefficient of friction is measured for line contact dowel pin sliding on a flat surface with 100 N load at 5 Hz frequency. Test additive compositions included 1 wt % of 1:1 mixtures of COM-MOFM1 and triethyl citrate (V2C); COM-MOFM2 and triethyl citrate (V5C); the MoFM according to Example 1 and triethyl citrate (MC); a 3:1 mixture of the alkanolamide prepared according to Example 1 and the MoFM prepared according to Example 1 (M3A); and the MoFM according to Example 1 on its own (M). Again, excellent performance was seen for the exemplary composition of the present disclosure, particularly at the important low entrainment speeds. It is also noted that the use of citrate esters was not nearly as effective at the low entrainment speeds as the alkanolamides of the present disclosure.

Example 3

In another example, the following compositions were prepared using Group III 5W-30 motor oil, which was a full formulation without any friction modifier but containing all other additives: 5W-30 oil without any friction modifier (S); 5W-30 oil and 1 wt %, based on the weight of the composition, of the molybdenum based lubricating oil additive (M); 5W-30 oil and 1 wt %, based on the weight of the composition, of the alkanolamide mixture (A); and (3) 5W-30 oil and 1 wt %, based on the weight of the composition, of the molybdenum based lubricating oil additive and alkanolamide at a 1:1 weight ratio (AM). As above, the molybdenum based lubricating oil additive was prepared according to the process of U.S. Pat. No. 6,103,674 from canola oil, a long chain ether containing diamine, carbon disulfide and molybdenum trioxide. The alkanolamide was a mixture of alkanolamides of formula II wherein R was methyl and about 15 to about 45% by weight of the alkanolamides were compounds where R' was $C_{15}$ alkyl or alkenyl, about 40 to about 80% by weight of the alkanolamides were compounds where R' was $C_{17}$ alkyl or alkenyl, and 1 to about 15% by weight of the alkanolamides were compounds where R' was $C_{7-14}$, $C_{16}$ or $C_{18-19}$ alkyl or alkenyl, prepared according to the process of U.S. Pat. No. 9,562,207 using di-iso-propanolamine and methyl tallowate.

Figure 3:
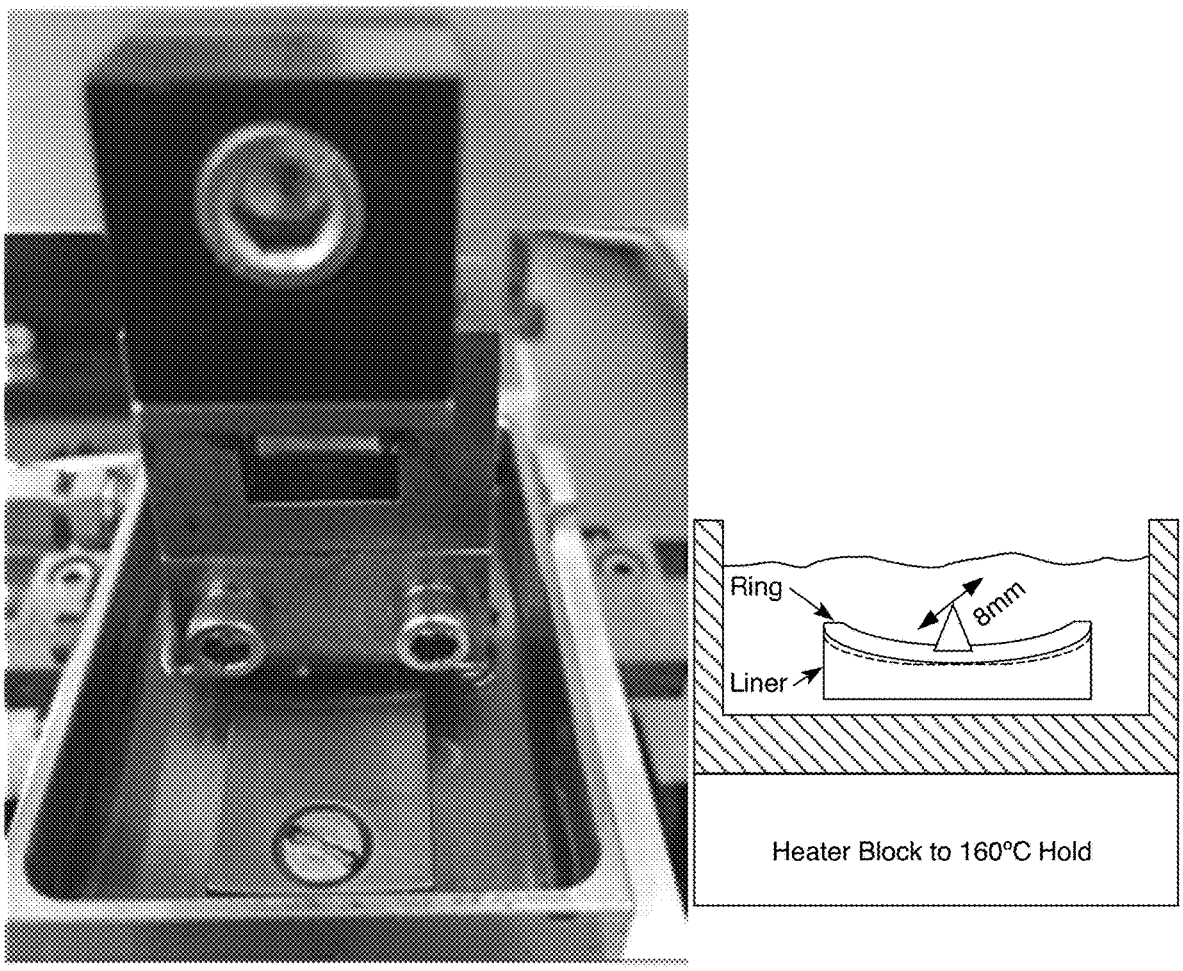
FIG. 3 shows the ring-on-liner apparatus used to conduct certain performance retention testing.
Figure 4:
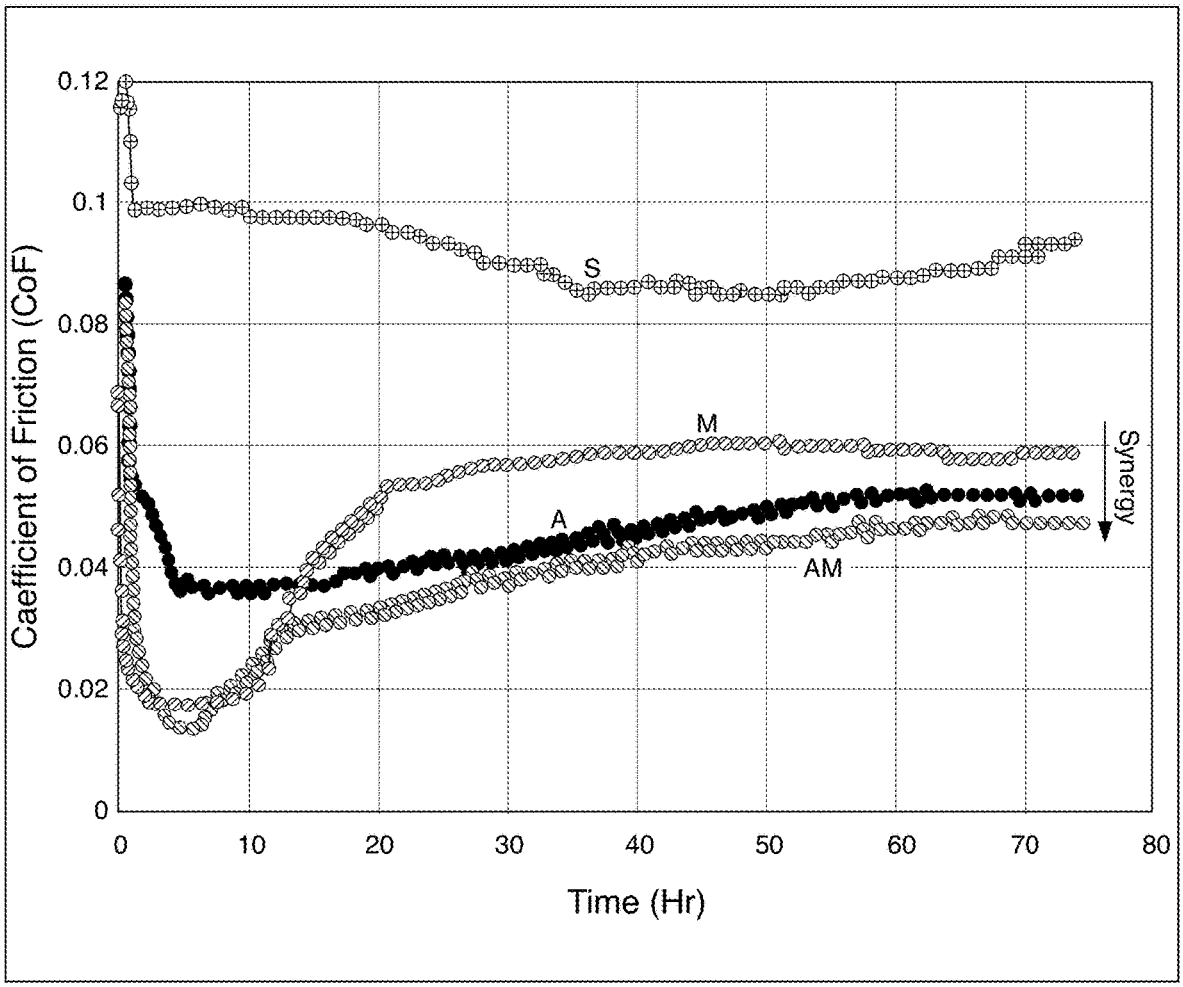
FIG. 4 shows the improvement in retaining friction reduction over time when using an exemplary additive composition according to the present disclosure.

Performance retention was evaluated using an apparatus as shown in FIG. 3, where the coefficient of friction was measured over time at 160° C. (TE-77 isothermal testing) for ring-on-liner contact. The coefficient of friction was measured over time at 160° C. (isothermal testing) for line contact (1 mm piston ring sliding against 20 mm cylinder liner surface) with 100 N load at 1.75 Hz frequency and 4.5 mm amplitude stroke length. As shown in FIG. 4, results similar to those in FIG. 1 were observed. In particular, once again, the molybdenum additive/alkanolamide combination (0.5% molybdenum additive plus 0.5% alkanolamide) (AM) showed great improvement over the use of either of the components alone. In addition, the observed synergy allows one to achieve such improved performance using lower molybdenum content.

Example 4

Figure 5:
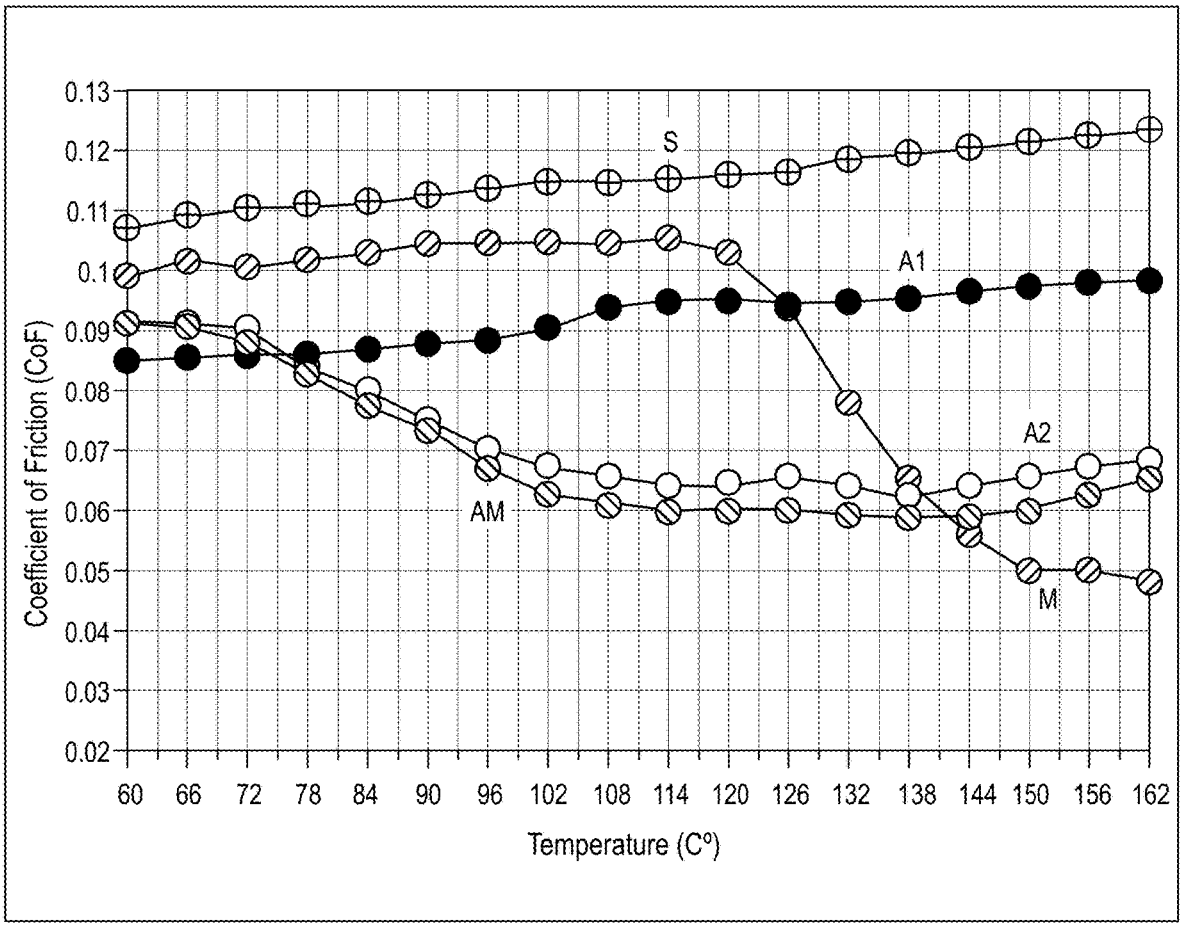
FIG. 5 shows improved performance when using an exemplary additive composition according to the present disclosure in tribology testing as a function of temperature.

In a further example, improved friction reduction performance was observed in heavy duty diesel engine oil (HD-DEO). For these studies, the coefficient of friction was measured as temperature increased from 60° C. to 160° C. for line contact (dowel pin sliding on a flat surface) with 100 N load at 1.75 Hz frequency and 4.5 mm amplitude stroke length. FIG. 5 shows the results as a function of temperature under the above test conditions, using SAE 15W-40 (CJ-4) standard without any friction modifier (S), the standard plus 1 wt % of the alkanolamide above (A1), the standard plus 2 wt % of the alkanolamide (A2), the standard plus 1 wt % of the molybdenum additive above (M), and the standard plus 1.25 wt % of the alkanolamide and 0.3 wt % of the molybdenum additive (AM). At temperatures above 78° C., the 2 wt % alkanolamide additive (A2) significantly outperformed the 1 wt % alkanolamide additive (A2). Importantly, the combination of 1.25 wt % of the alkanolamide and 0.3 wt % of the molybdenum additive (AM) showed further improvement over A2. In addition, with the exception of temperatures over 144° C., the combination (AM), which included the molybdenum additive at only 0.3 wt %, showed a large improvement in performance over the molybdenum additive alone at 1 wt % (M).

Figure 6:
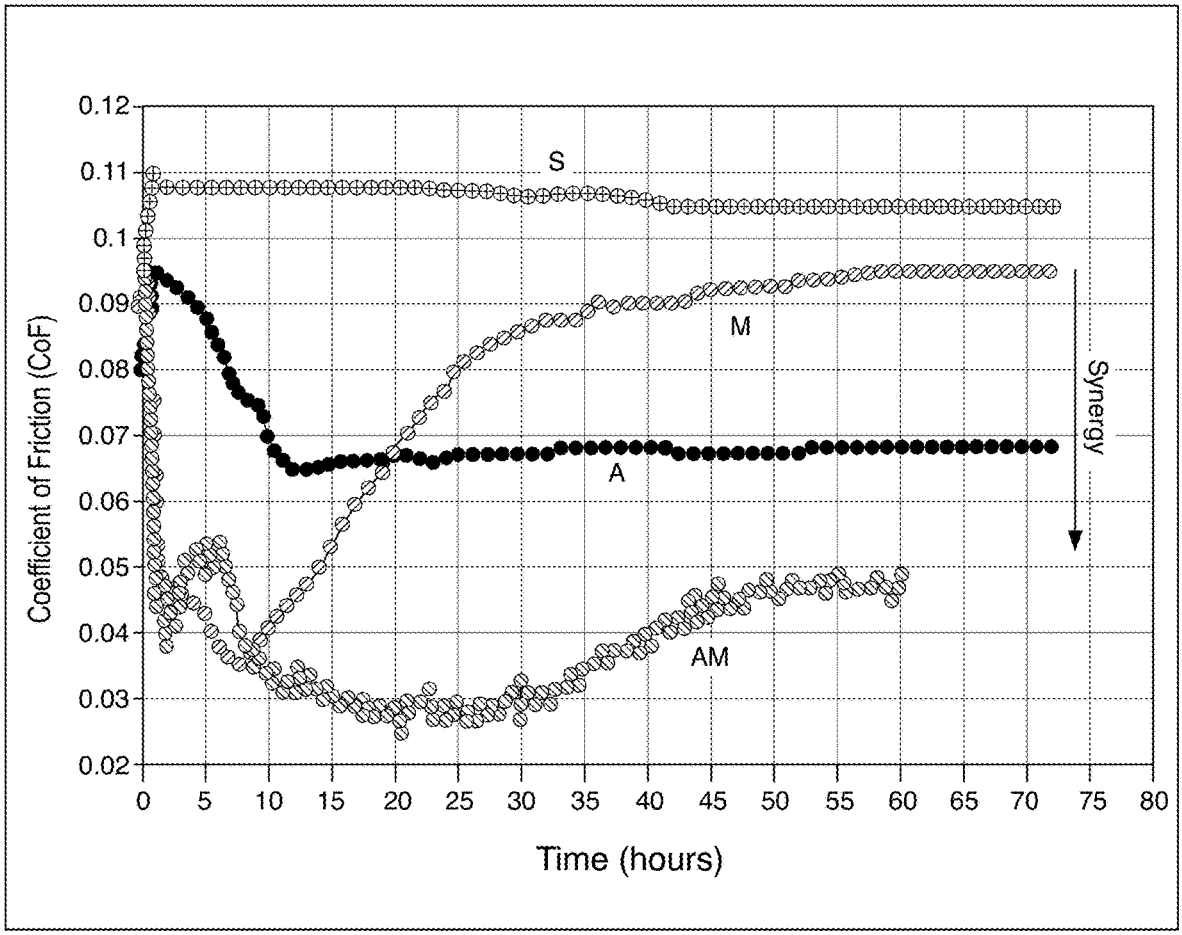
FIG. 6 shows the improvement in retaining friction reduction over time when using an exemplary additive composition of the present disclosure.

FIG. 6 shows the results of performance retention testing where the coefficient of friction was measured over time at 160° C. (isothermal testing) for line contact (dowel pin sliding on a flat surface) with 100 N load at 1.75 Hz frequency and 4.5 mm amplitude stroke length using HDDEO SAE 15W-40 standard without any friction modifier (S), the standard plus 1 wt % of the alkanolamide above (A), the standard plus 1 wt % of the molybdenum additive above (M), and the standard plus 0.5 wt % of the alkanolamide and 0.5 wt % of the molybdenum additive (AM). Once again, at the same total load level, the molybdenum additive/alkanolamide combination (AM) showed great improvement over the use of either of the additives alone.

Example 5

Figure 7:
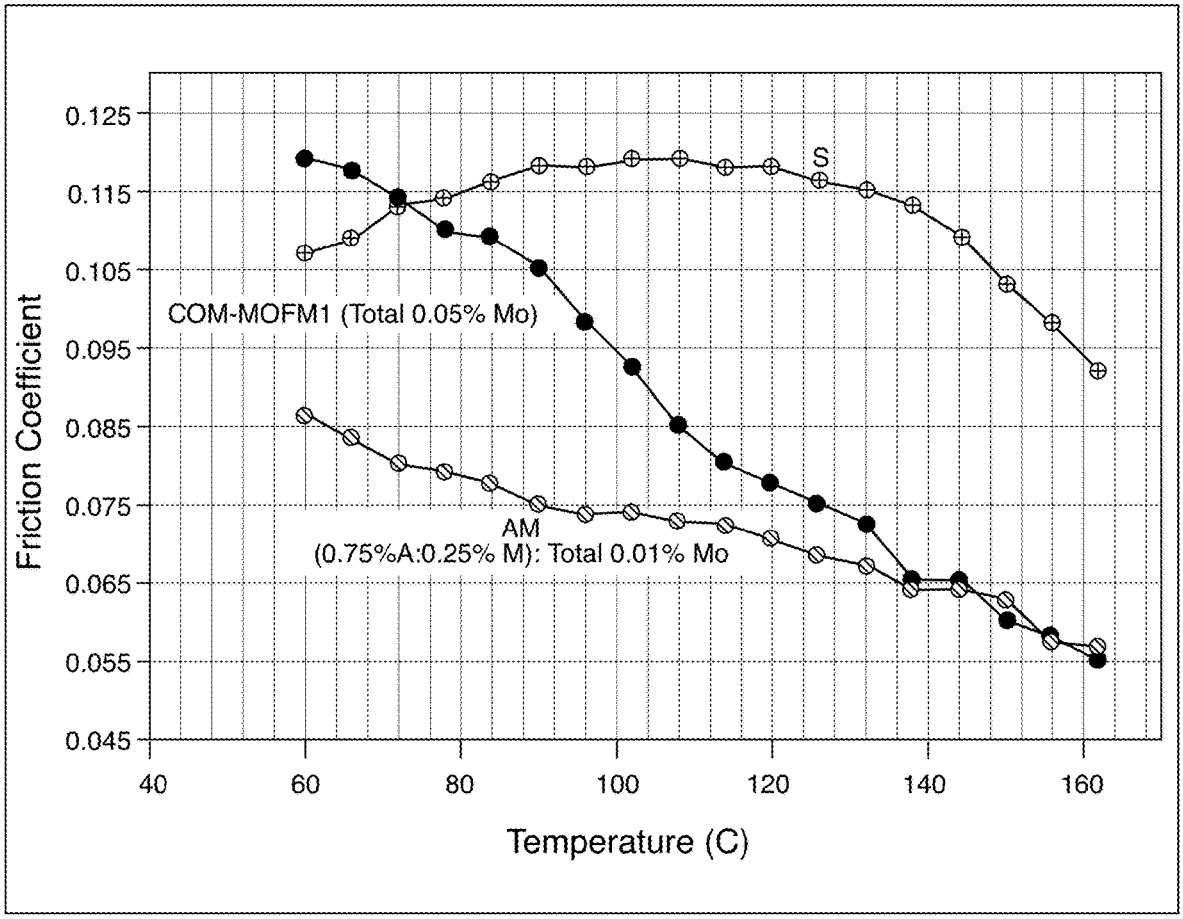
FIG. 7 shows improved performance when using an exemplary additive composition of the present disclosure in tribology testing as a function of temperature.

Coefficient of friction was measured as temperature increased from 60° C. to 160° C. for line contact (dowel pin sliding on a flat surface) with 100 N load at 5.0 Hz frequency and 2.35 mm amplitude stroke length. FIG. 7 shows the results as a function of temperature under the above test conditions using 5W-30 Group III PCMO without any friction modifier (the standard (S)), the standard plus 1 wt % of the commercial molybdenum dithiocarbamate friction modifier COM-MOFM1, and the standard plus 1 wt % of the mixture of the alkanolamide above and the molybdenum additive above at a 1:3 ratio by weight of molybdenum additive to alkanolamide (AM). The molybdenum content in the lubricant composition containing the commercial molybdenum friction modifier (COM-MOFM1) was approximately 0.05% (approximately 5% Mo content in the commercial additive at a treat rate of 1%), whereas the molybdenum content in the lubricant composition containing the mixture of the alkanolamide and molybdenum additive (AM) was approximately 0.01% (approximately 4% Mo content in the molybdenum additive of the Example at a treat rate of 0.25%). Despite containing approximately 5 times less molybdenum, the lubricant composition containing the mixture of additives (AM) exhibited highly superior performance from the outset of the experiment (at 60° C.) to about 130° C., around which point the friction coefficient for the COM-MOFM1 composition began to catch up with that of the AM sample.

Example 6

Figure 8:
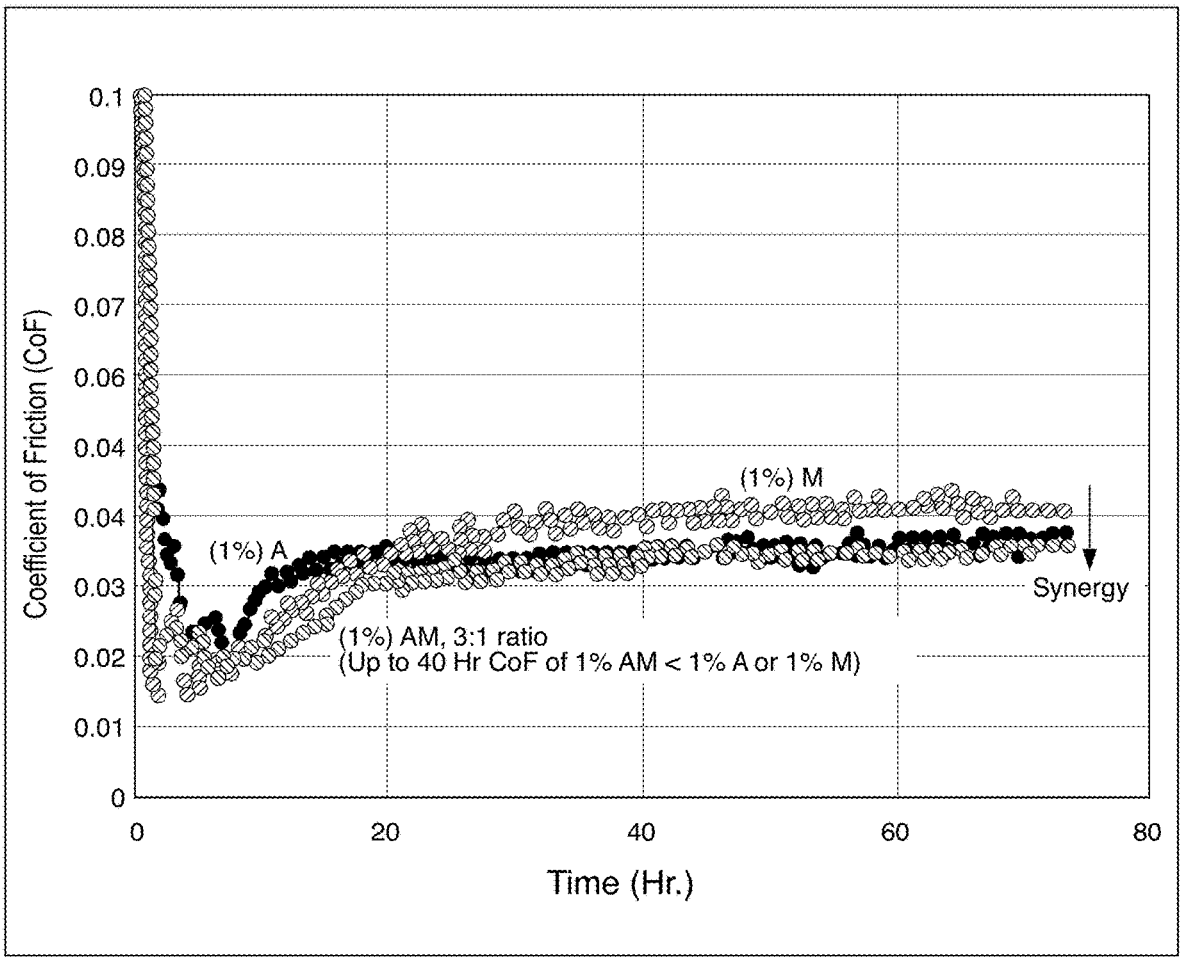
FIG. 8 shows superior friction reduction performance over time of an exemplary additive composition of the present disclosure.

FIG. 8 shows the results of performance retention testing where the coefficient of friction was measured over time at 160° C. (isothermal testing) for line contact (dowel pin sliding on a flat surface) with 100 N load at 1.75 Hz frequency and 4.5 mm amplitude stroke length using 0W-20 PCMO without any friction modifier (the standard (S)), the standard plus 1 wt % of the alkanolamide above (A), the standard plus 1 wt % of the molybdenum additive above (M), and the standard plus 0.75 wt % of the alkanolamide and 0.25 wt % of the molybdenum additive (AM). At the same total load level (1%), the molybdenum additive/alkanolamide combination (AM) consistently showed greater friction reduction performance up to about 40 hours over the use of the additives alone.

Example 7

Figure 9:
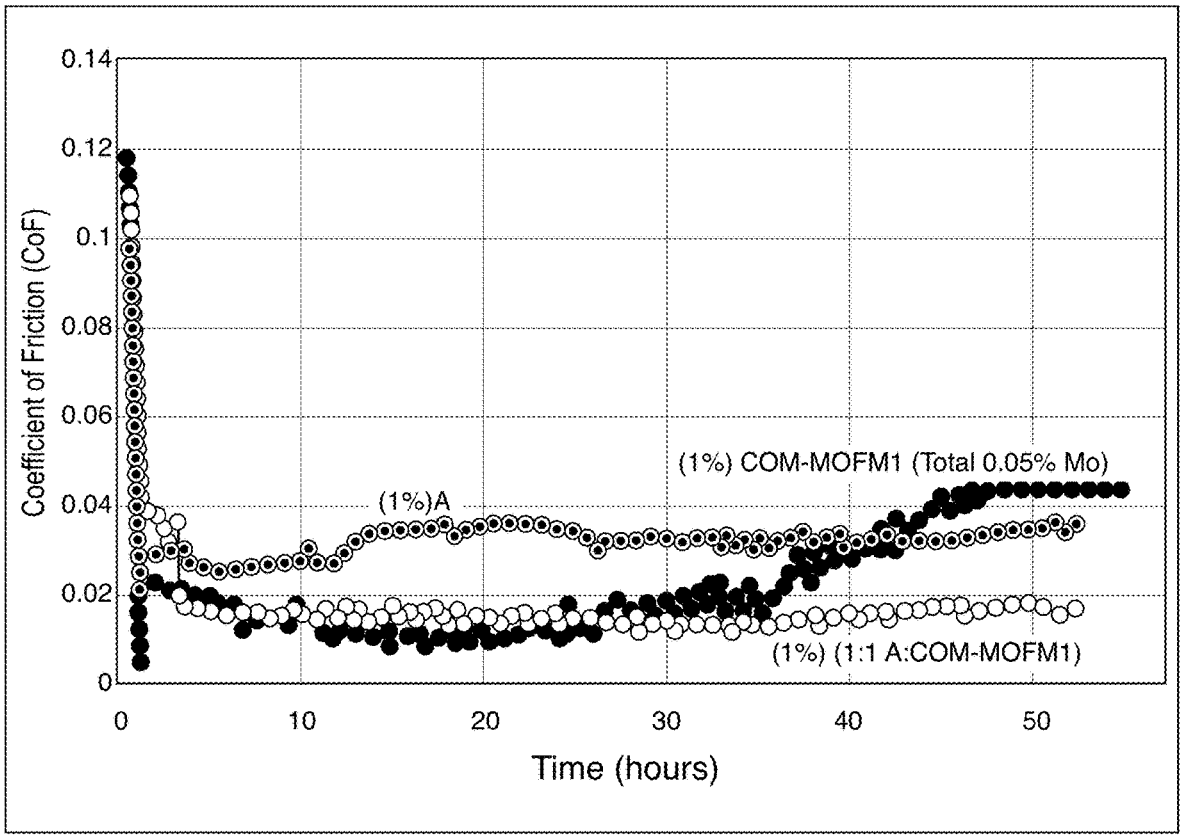
FIG. 9 shows superior retention of friction reduction performance of an exemplary additive composition of the present disclosure.

FIG. 9 shows the results of performance retention testing where the coefficient of friction was measured over time at 160° C. (isothermal testing) for line contact (dowel pin sliding on a flat surface) with 100 N load at 1.75 Hz frequency and 4.5 mm amplitude stroke length. The additives were added to a 0W-20 PCMO without any friction modifier. The following formulations were tested: (1) the alkanolamide above at a treat rate of 1 wt % (A); (2) COM-MOFM1 (i.e., a commercially available di-molybdenum dithiocarbamate) at a treat rate of 1 wt % (Mo concentration in the resulting formulation was approximately 0.05%); and (3) a 1:1 combination by weight of the alkanolamide above and COM-MOFM1 at a treat rate of 1 wt % (A:COM-MOFM1). Once again, as shown in FIG. 9, the synergy of the alkanolamide/molybdenum additive combination resulted in superior retention of friction reduction performance.

Although particular embodiments of the present invention have been illustrated and described, this description is not meant to be construed in a limiting sense. Various changes and modifications may be made without departing from the principle and scope of the present invention, which is defined by the appended claims.

What is claimed:

1. A lubricant additive composition comprising a friction reducing effective amount of the combination of (a) a mixture of fatty acid alkanolamide compounds of formula (II):

(II)

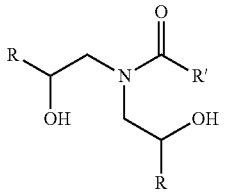

wherein

R is H or $C_{1-12}$ alkyl, and

R' is selected from $C_{7-23}$ alkyl or alkenyl; and (b) a molybdenum based lubricating oil friction reducing additive, wherein the ratio by weight of component (b) to component (a) is 5:1 to 1:5, wherein the mixture of fatty acid alkanolamide compounds comprises at least one compound of formula (II) where R' is $C_{15}$ alkyl or alkenyl and at least one compound of formula (II) where R' is $C_{17}$ alkyl or alkenyl, and the majority of R' groups in the are selected from $C_{13}$, $C_{15}$ and $C_{17}$ alkyl or alkenyl, wherein about 15 to about 45% by weight of the fatty acid alkanolamides are compounds where R' is $C_{15}$ alkyl or alkenyl, about 40 to about 80% by weight of the fatty acid alkanolamides are compounds where R' is $C_{17}$ alkyl or alkenyl, and 0 to about 15% by weight of the fatty acid alkanolamides are compounds where R' is $C_{7-14}$, $C_{16}$ or $C_{18-19}$ alkyl or alkenyl.

2. The lubricant additive composition according to claim 1, wherein the weight ratio of component (b) to component (a) is 3:1 to 1:3.

3. The lubricant additive composition according to claim 1, wherein the weight ratio of component (b) to component (a) is 1:1.1 to 1:5.

4. The lubricant additive composition according to claim 1, wherein the molybdenum based friction reducing additive is chosen from the group consisting of molybdenum dithiocarbamates (MoDTC), molybdenum dithiophosphates, molybdenum dithiophosphinates, molybdenum xanthates, molybdenum thioxanthates, molybdenum sulfides, and mixtures thereof.

5. The lubricant additive composition according to claim 1, wherein the molybdenum based lubricating oil friction reducing additive is the reaction product of:

(a) a mono- or polyfunctional organic acid or ester of the formula:

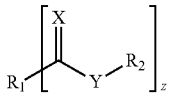

wherein $R_1$ is a straight chain or branched chain or cyclic, saturated or unsaturated, hydrocarbon moiety of 1 to 44 carbon atoms, $R_2$ is hydrogen, a hydrocarbon radical, or a functionalized hydrocarbon radical, having 1 to 18 carbon atoms, Z is an integer of 1 to 5, and X and Y are independently selected from the group consisting of sulfur and oxygen;

(b) a diamine of the formula

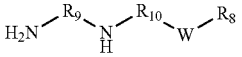

wherein $R_6$ is an alkyl group of 1 to 40 carbon atoms, $R_9$ and $R_{10}$ are independently selected aliphatic or aromatic moieties, and N is oxygen, sulfur, or —$CH_2$—;

(c) carbon disulfide; and (d) a molybdenum compound.

6. The lubricant additive composition according to claim 5, wherein the molybdenum compound is selected from molybdic acid, ammonium molybdate, $MoOCl_4$, $MoO_2Br_2$, $Mo_2O_3Cl_5$, $MoO_3$, and the thio analogues of the foregoing.

7. The lubricant additive composition according to claim 5, wherein a vegetable oil is used as the source of the organic ester.

8. The lubricant additive composition according to claim 5, wherein the organic ester comprises ethylene glycol dioleate, propylene glycol dioleate, butanediol dioleate, glycerol monooleate, glycerol linoleate, glycerol linolenate, glycerol trioleate, pentaerythritol tetreoleate, pentaerythritol trioleate monomyristate, trimethylol propane trioleate, trimethylol propane dioleate monomyristate, trimethylol propane dilinoleate monooleate, dioleyl adipate, dioleyl sebacate, dioleyl maleate, dioleyl succinate, or dilinoleyl adipate.

9. The lubricant additive composition according to claim 7, wherein the vegetable oil comprises canola oil, corn oil, coconut oil, sunflower oil, soybean oil, lard, or palm oil.

10. The lubricant additive composition according to claim 5, wherein the diamine comprises octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane.

11. The lubricant additive composition according to claim 1, wherein the molybdenum based lubricating oil friction reducing additive is the reaction product of (a) a vegetable oil;

(b) a diamine comprising octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane;

(c) carbon disulfide; and (d) $MoO_3$.

12. The lubricant additive composition according to claim 1, wherein R is chosen from $C_{1-4}$ alkyl.

13. The lubricant additive composition according to claim 1, wherein the mixture of fatty acid alkanolamide compounds of formula II are prepared by reacting a di(hydroxyalkyl) amine with carboxylic acids or carboxylic acid derivatives derived from the group chosen from lard, palm oil, or beef tallow.

14. The lubricant additive composition according to claim 13, wherein the di(hydroxyalkyl) amine is bis(2-hydroxypropyl)amine.

15. The lubricant additive composition according to claim 14, wherein the one or more fatty acid alkanolamides are prepared by reacting the bis(2-hydroxypropyl)amine with methyl esters derived from beef tallow carboxylates.

16. The lubricant additive composition according to claim 1, wherein the molybdenum based lubricating oil friction reducing additive comprises a molybdenum dithiocarbamate represented by the formula:

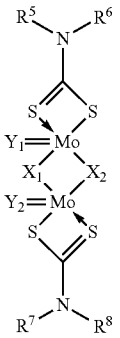

wherein $R^5$, $R^6$, $R^7$, and $R^8$ each independently represent a hydrogen atom, a $C_{1-20}$alkyl or alkenyl group, a $C_{5-20}$ cycloalkyl, aryl, alkylaryl, or aralkyl group, or a $C_{3-20}$ hydrocarbyl group terminating in an ester, ether, alcohol, amine, amide or carboxyl group; and $X_1$, $X_2$, $Y_1$, and $Y_2$ each independently represent a sulfur or oxygen atom.

17. A lubricant composition comprising a majority component by weight, based on the weight of the composition, of a lubricating oil; and from about 0.3 to about 3 wt. %, based on the weight of the composition, of the combination of (a) a mixture of fatty add alkanolamide compounds of formula (II):

(I)

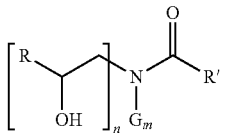

wherein

R is H or $C_{1-12}$ alkyl, and

R' is selected from $C_{7-23}$ alkyl or alkenyl, and (b) a molybdenum based lubricating oil friction reducing additive, wherein the ratio by weight of component (b) to component (a) is 5:1 to 1:5, wherein the mixture of fatty acid alkanolamide compounds comprises at least one compound of formula (II) where R' is $C_{15}$ alkyl or alkenyl and at least one compound of formula (II) where R' is $C_{17}$ alkyl or alkenyl, and the majority of R' in the mixture are selected from $C_{13}$, $C_{15}$ and $C_{17}$ alkyl or alkenyl, wherein about 15 to about 45% by weight of the fatty acid alkanolamides are compounds where R' is $C_{15}$ alkyl or alkenyl, about 40 to about 80% by weight of the fatty acid alkanolamides are compounds where R' is $C_{17}$ alkyl or alkenyl, and 0 to about 15% by weight of the fatty acid alkanolamides are compounds where R' is $C_{7-14}$, $C_{16}$ or $C_{18-19}$ alkyl or alkenyl.

18. The lubricant composition according to claim 17, wherein the weight ratio of component (b) to component (a) is 3:1 to 1:3.

19. The lubricant composition according to claim 17, wherein the weight ratio of component (b) to component (a) is 1:1.1 to 1:5.

20. The lubricant composition according to claim 17, wherein the molybdenum based friction reducing additive is chosen from the group consisting of molybdenum dithiocarbamates (MoDTC), molybdenum dithiophosphates, molybdenum dithiophosphinates, molybdenum xanthates, molybdenum thioxanthates, molybdenum sulfides, and mixtures thereof.

21. The lubricant composition according to claim 17, wherein the molybdenum based lubricating oil friction reducing additive is the reaction product of:

(a) a mono- or polyfunctional organic acid or ester of the formula:

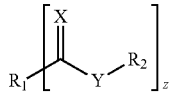

wherein $R_1$ is a straight chain or branched chain or cyclic, saturated or unsaturated, hydrocarbon moiety of 1 to 44 carbon atoms, $R_2$ is hydrogen, a hydrocarbon radical, or a functionalized hydrocarbon radical, having 1 to 18 carbon atoms, Z is an integer of 1 to 5, and X and Y are independently selected from the group consisting of sulfur and oxygen;

(b) a diamine of the formula

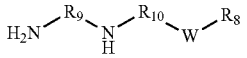

wherein $R_8$ is an alkyl group of 1 to 40 carbon atoms, $R_9$ and $R_{10}$ are independently selected aliphatic or aromatic moieties, and W is oxygen, sulfur, or —$CH_2$—;

(c) carbon disulfide; and (d) a molybdenum compound.

22. The lubricant composition according to claim 17, wherein the molybdenum based lubricating oil friction reducing additive is the reaction product of (a) a vegetable oil;

(b) a diamine comprising octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane;

(c) carbon disulfide; and (d) $MoO_3$.

23. The lubricant composition according to claim 17, wherein R is chosen from $C_{1-4}$ alkyl.

24. The lubricant composition according to claim 17, wherein the molybdenum based lubricating oil friction reducing additive comprises a molybdenum dithiocarbamate represented by the formula:

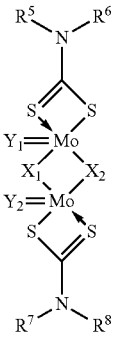

wherein $R^5$, $R^6$, $R^7$, and $R^8$ each independently represent a hydrogen atom, a $C_{1-20}$alkyl or alkenyl group, a $C_{5-20}$ cycloalkyl, aryl, alkylaryl, or aralkyl group, or a $C_{3-20}$ hydrocarbyl group terminating in an ester, ether, alcohol, amine, amide or carboxyl group; and $X_1$, $X_2$, $Y_1$, and $Y_2$ each independently represent a sulfur or oxygen atom.

25. A method of improving the friction reduction performance of a lubricant composition, which lubricant composition comprises a majority component, based on the weight of the lubricant composition, of a lubricating oil comprising one or more naturally occurring base stocks or synthetic base stocks, the method comprising adding to the lubricating oil (a) a mixture of fatty acid alkanolamide compounds of formula (II):

(I)

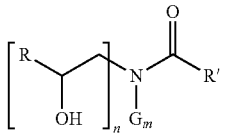

wherein

R is H or $C_{1-12}$ alkyl, and

R' is selected from $C_{7-23}$ alkyl or alkenyl, and (b) a molybdenum based lubricating oil friction reducing additive, wherein component (a) and component (b) are added in a combined amount of from about 0.3 to about 3 wt. %, based on the total weight of the lubricant composition, and at a ratio by weight of component (b) to component (a) of 5:1 to 1:5, wherein the mixture of fatty acid alkanolamide compounds comprises at least one compound of formula (II) where R' is $C_{15}$ alkyl or alkenyl and at least one compound of formula (II) where R' is $C_{17}$ alkyl or alkenyl, and the majority of R' groups in the mixture are selected from $C_{13}$, $C_{15}$ and $C_{17}$ alkyl or alkenyl, wherein about 15 to about 45% by weight of the fatty acid alkanolamides are compounds where R' is $C_{15}$ alkyl or alkenyl, about 40 to about 80% by weight of the fatty acid alkanolamides are compounds where R' is $C_{17}$ alkyl or alkenyl, and 0 to about 15% by weight of the fatty acid alkanolamides are compounds where R' is $C_{7-14}$, $C_{16}$ or $C_{18-19}$ alkyl or alkenyl.

26. The method according to claim 25, wherein the weight ratio of component (b) to component (a) is 3:1 to 1:3.

27. The method according to claim 25, wherein the weight ratio of component (b) to component (a) is 1:1.1 to 1:5.

28. The method according to claim 25, wherein the molybdenum based friction reducing additive is chosen from the group consisting of molybdenum dithiocarbamates (MoDTC), molybdenum dithiophosphates, molybdenum dithiophosphinates, molybdenum xanthates, molybdenum thioxanthates, molybdenum sulfides, and mixtures thereof.

29. The method according to claim 25, wherein the molybdenum based lubricating oil friction reducing additive is the reaction product of (a) a vegetable oil;

(b) a diamine comprising octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coca-1,3-diaminopropanes, N-tallow-1,3-diaminopropanes, or N-oleyl-1,3-diaminopropane;

(c) carbon disulfide; and (d) $MoO_3$.

* * * * *